US009429051B2

(12) United States Patent
Meneely et al.

(10) Patent No.: US 9,429,051 B2
(45) Date of Patent: Aug. 30, 2016

(54) COMPRESSION-RELEASE ENGINE BRAKE SYSTEM FOR LOST MOTION ROCKER ARM ASSEMBLY AND METHOD OF OPERATION THEREOF

(71) Applicant: PACBRAKE COMPANY, Blaine, WA (US)

(72) Inventors: Vincent Meneely, Fort Langley (CA); Robert Price, Manchester, CT (US)

(73) Assignee: Pacbrake Company, Blaine, WA (US)

( * ) Notice: Subject to any disclaimer, the term of this patent is extended or adjusted under 35 U.S.C. 154(b) by 147 days.

(21) Appl. No.: 14/553,177

(22) Filed: Nov. 25, 2014

(65) Prior Publication Data

US 2015/0144096 A1 May 28, 2015

Related U.S. Application Data

(60) Provisional application No. 61/908,272, filed on Nov. 25, 2013, provisional application No. 62/001,392, filed on May 21, 2014.

(51) Int. Cl.

| | |
|---|---|
| ***F02D 13/04*** | (2006.01) |
| ***F01L 13/06*** | (2006.01) |
| ***F01L 1/18*** | (2006.01) |
| ***F01L 1/26*** | (2006.01) |

(52) U.S. Cl.

CPC ..... *F01L 13/06* (2013.01); *F01L 1/18* (2013.01); *F01L 1/181* (2013.01); *F01L 1/26* (2013.01); *F01L 13/065* (2013.01); *F02D 13/04* (2013.01)

(58) Field of Classification Search

CPC ..... F01L 13/06; F01L 1/26; F01L 1/18; F01L 13/065; F01L 1/181; F02D 13/04

See application file for complete search history.

(56) References Cited

U.S. PATENT DOCUMENTS

| | | | |
|---|---|---|---|
| 4,399,787 | A | 8/1983 | Cavanagh |
| 5,460,131 | A | 10/1995 | Usko |
| 5,564,385 | A | 10/1996 | Hakansson |
| 5,829,397 | A | 11/1998 | Vorih et al. |
| 5,890,469 | A | 4/1999 | Hakansson et al. |
| 6,000,374 | A | 12/1999 | Cosma et al. |
| 6,253,730 | B1 | 7/2001 | Gustafson |
| 6,334,429 | B1 | 1/2002 | Little, Jr. |
| 6,386,160 | B1 | 5/2002 | Meneely et al. |

(Continued)

FOREIGN PATENT DOCUMENTS

| | | | |
|---|---|---|---|
| WO | 0118373 | A1 | 3/2001 |
| WO | 2012109780 | A1 | 8/2012 |

*Primary Examiner* — Hung Q Nguyen

(74) *Attorney, Agent, or Firm* — Berenato & White, LLC

(57) ABSTRACT

A compression-release brake system comprises an exhaust rocker arm, an actuation piston slidable in a piston bore in the exhaust rocker arm so as to press an exhaust valve, a supply conduit formed within the exhaust rocker arm, and an exhaust valve reset device mounted to the exhaust rocker arm. The actuation piston defines an actuation piston cavity within the actuation piston bore between the piston bore and the actuation piston. The exhaust valve reset device includes a reset check valve disposed between the supply conduit and the actuation piston cavity to hydraulically lock the actuation piston cavity by closing the reset check valve when a pressure of the hydraulic fluid within the actuation piston cavity exceeds the pressure of the hydraulic fluid in the supply conduit. The reset check valve is biased closed by the pressure of the hydraulic fluid within the actuation piston cavity during the brake-on mode.

36 Claims, 27 Drawing Sheets

(56) References Cited

U.S. PATENT DOCUMENTS

| | | | |
|---|---|---|---|
| 6,394,067 | B1 | 5/2002 | Usko et al. |
| 6,422,186 | B1 | 7/2002 | Vanderpoel |
| 6,439,195 | B1 | 8/2002 | Warner |
| 6,450,144 | B2 | 9/2002 | Janak et al. |
| 6,594,996 | B2 | 7/2003 | Yang |
| 6,691,674 | B2 | 2/2004 | McCarthy et al. |
| 6,694,933 | B1 | 2/2004 | Lester |
| 6,718,940 | B2 | 4/2004 | Usko |
| 6,866,017 | B2 | 3/2005 | Ruggiero et al. |
| 6,904,892 | B1 | 6/2005 | Afjeh et al. |
| 6,925,976 | B2 | 8/2005 | Israel et al. |
| 7,520,262 | B2 | 4/2009 | Jeong et al. |
| 7,789,065 | B2 | 9/2010 | Yang |
| 7,823,553 | B2 | 11/2010 | Meistrick |
| 7,909,015 | B2 | 3/2011 | Yang |
| 7,909,017 | B2 | 3/2011 | Yang |
| 7,984,705 | B2 | 7/2011 | Yang |
| 8,065,987 | B2 | 11/2011 | Yang |
| 8,146,566 | B2 | 4/2012 | Lee et al. |
| 8,161,936 | B2 | 4/2012 | Kraft |
| 8,225,769 | B2 | 7/2012 | Dilly |
| 8,240,278 | B2 | 8/2012 | Jeon et al. |
| 8,887,679 | B2 | 11/2014 | Girard et al. |
| 8,991,341 | B2 | 3/2015 | LeForestier |
| 8,991,350 | B2 | 3/2015 | Yang |
| 9,016,249 | B2 | 4/2015 | Roberts et al. |
| 9,068,479 | B2 | 6/2015 | Hansson et al. |
| 9,163,534 | B2 | 10/2015 | Girard et al. |
| 9,163,566 | B2 | 10/2015 | LeForestier et al. |
| 9,249,698 | B2 | 2/2016 | Gustafson et al. |
| 2001/0027773 | A1 | 10/2001 | Janak et al. |
| 2002/0174849 | A1* | 11/2002 | Ruggiero ..... F01L 13/06 123/319 |
| 2003/0024501 | A1 | 2/2003 | McCarthy et al. |
| 2006/0081213 | A1 | 4/2006 | Yang et al. |
| 2010/0319657 | A1 | 12/2010 | Dodi et al. |
| 2011/0073068 | A1 | 3/2011 | Yoon et al. |
| 2012/0024260 | A1 | 2/2012 | Groth et al. |
| 2013/0319370 | A1 | 12/2013 | Yang |
| 2014/0130774 | A1 | 5/2014 | LeForestier et al. |
| 2014/0238324 | A1 | 8/2014 | Janak et al. |
| 2015/0101567 | A1 | 4/2015 | Park |
| 2015/0122220 | A1 | 5/2015 | Cecur |
| 2016/0025018 | A1* | 1/2016 | Gustafson ..... F01L 1/181 123/321 |

* cited by examiner

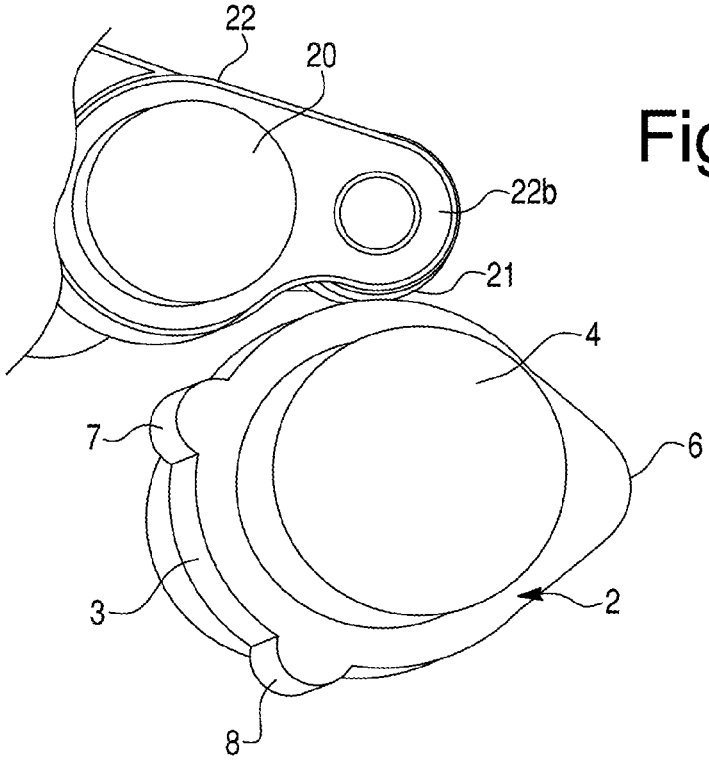
Fig. 2
Fig. 3
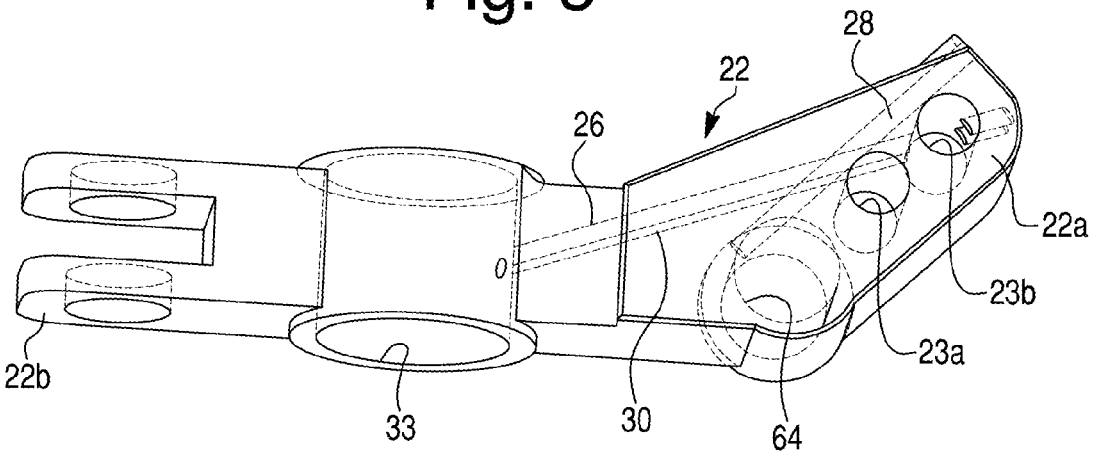

COMPRESSION-RELEASE ENGINE BRAKE SYSTEM FOR LOST MOTION ROCKER ARM ASSEMBLY AND METHOD OF OPERATION THEREOF

CROSS-REFERENCE TO RELATED APPLICATIONS

This application claims the benefit of provisional applications No. 61/908,272 filed on Nov. 25, 2013 by V. Meneely and R. Price, and of No. 62/001,392 filed on May 21, 2014 by V. Meneely and R. Price, which are hereby incorporated herein by reference in their entirety and to which priority is claimed.

BACKGROUND OF THE INVENTION

1. Field of the Invention

The present invention relates to compression-release engine brake systems in general, and more particularly to a compression-release engine brake system and method comprising a lost motion type engine brake rocker arm assembly incorporating structure implementing a valve reset function.

2. Description of the Related Art

Compression release engine brake systems (or retarders) for diesel engines were designed and developed in North America starting in the early 1960's. There have been many changes that have been implemented that have increased retarding performance, reduced cost, reduced engine loading and reduced engine valve train loading.

Conventionally, the engine brake compression release retarders change a power producing diesel engine to a power absorbing air compressor. The air in the cylinder is compressed on the compression stroke and is released near top dead center (TDC) just prior to the expansion stroke to reduce the cylinder pressure and prevent it from pushing the piston down on the expansion stroke. In the so-called exhaust brake systems, work on the air is done on the exhaust stroke when the piston is moving up and there is a pressure increase in the exhaust manifold from turbocharger restriction or an exhaust restriction.

The opening of the exhaust valve(s) near TDC to vacate cylinder pressure can be accomplished by a number of different approaches. Some of the most common methods used are add-on housings that hydraulically transfer intake or exhaust cam motion from a neighboring cylinder, or fuel injector motion from the same cylinder to provide a method of timing the exhaust valve(s) to open near TDC compression stroke to optimize the release of compressed air in the cylinder.

Other engine brake systems have a rocker arm brake that utilizes an exhaust rocker arm (or lever) to open the exhaust valve(s) near TDC compression stroke. A term used to identify a type of rocker arm brake is a lost motion concept. This concept adds an additional small lift profile to the exhaust cam lobe that opens the exhaust valve(s) near TDC compression stroke when excess exhaust valve lash is removed from the valve train.

Rocker arm brake systems using the lost motion principle have been known for many years. One problem with the conventional rocker arm brake system is that valve overlap at exhaust/intake is extended and thus braking performance decreased. Moreover, a problem with opening a single valve is that exhaust/intake overlap is extended and the opening up an exhaust bridge is unbalanced during the initial normal exhaust lift and might result in engine overhead damage. Extended overlap allows exhaust gas to flow backwards into the engine from the exhaust manifold and through the inlet valve into the inlet manifold. In other words, the extended valve overlap causes an undesired exhaust manifold air mass flow into the engine intake system, thus reducing exhaust stroke work and decreasing braking performance.

We disclose a system to open the exhaust valve(s) as late as possible, open the exhaust valves the maximum amount at a faster rate, and evacuating the cylinder quickly to provide a very high performance engine brake. There are a number of engine parameters that restrict the optimum valve opening. These limitations include valve train loading, engine design limits, emissions regulations and other considerations.

SUMMARY OF THE INVENTION

According to a first aspect of the invention, a compression-release brake system is configured to operate at least one exhaust valve of an internal combustion engine. The compression-release brake system of the present invention operates in a brake-on mode during a compression-release engine braking operation and a brake-off mode during a positive power operation. The compression-release brake system maintains the at least one exhaust valve open during a portion of a compression stroke of the engine when performing the compression-release engine braking operation. The compression-release brake system comprises an exhaust rocker assembly for operating the at least one exhaust valve. The exhaust rocker assembly includes an exhaust rocker arm mounted about a rocker shaft and selectively pivotable to open the at least one exhaust valve. The compression-release brake system further comprises an actuation piston moveable between retracted and extended positions and slidably disposed in an actuation piston bore formed in said exhaust rocker arm. The actuation piston is operatively coupled to the at least one exhaust valve when in the extended position. The actuation piston defines an actuation piston cavity within the actuation piston bore between the actuation piston bore and the actuation piston. The compression-release brake system further comprises a supply conduit formed within the exhaust rocker arm. The supply conduit is configured to supply pressurized hydraulic fluid to the actuation piston cavity to displace the actuation piston to the extended position when there is a gap between the actuation piston and the at least one exhaust valve. The compression-release brake system further comprises an exhaust valve reset device mounted to the exhaust rocker arm. The exhaust valve reset device includes a reset check valve disposed between the supply conduit and the actuation piston cavity to hydraulically lock the actuation piston cavity by closing the reset check valve when pressure of the hydraulic fluid within the actuation piston cavity exceeds the pressure of the hydraulic fluid in the supply conduit. The reset check valve is biased closed by the pressure of the hydraulic fluid within the actuation piston cavity during the brake-on mode.

According to a second aspect of the invention, there is provided a method of operating a compression-release brake system in a brake-on mode for operating at least one exhaust valve of an internal combustion engine during a portion of a compression-release engine braking operation. The compression-release brake system maintains the at least one exhaust valve open during a compression stroke of the engine when performing the compression-release engine braking operation. The compression-release brake system comprises an exhaust rocker assembly for operating the at least one exhaust valve. The exhaust rocker assembly includes an exhaust rocker arm mounted about a rocker shaft and selectively pivotable to open the at least one exhaust valve. The compression-release brake system further comprises an actuation piston moveable between retracted and extended positions and slidably disposed in an actuation piston bore formed in said exhaust rocker arm. The actuation piston is operatively coupled to the at least one exhaust valve when in the extended position. The actuation piston defines an actuation piston cavity within the actuation piston bore between the actuation piston bore and the actuation piston. The compression-release brake system further comprises a supply conduit formed within the exhaust rocker arm. The supply conduit is configured to supply pressurized hydraulic fluid to the actuation piston cavity to displace the actuation piston to the extended position when there is a gap between the actuation piston and the at least one exhaust valve. The compression-release brake system further comprises an exhaust valve reset device mounted to the exhaust rocker arm. The exhaust valve reset device includes a reset check valve disposed between the supply conduit and the actuation piston cavity to hydraulically lock the actuation piston cavity by closing the reset check valve when pressure of the hydraulic fluid within the actuation piston cavity exceeds the pressure of the hydraulic fluid in the supply conduit. The reset check valve is biased by the pressure of the hydraulic fluid within the actuation piston cavity during the brake-on mode. The reset check valve is biased closed by the pressure of the hydraulic fluid within the actuation piston cavity during part of the brake-on mode.

The method comprises the steps of mechanically biasing the reset check valve closed during a first part of a valve brake lift of the at least one exhaust valve during a compression stroke of the internal combustion engine, hydraulically biasing the reset check valve closed during a second part of a valve brake lift of the at least one exhaust valve, and resetting the at least one exhaust valve during an expansion stroke of the engine by opening the reset check valve and releasing hydraulic fluid from the actuation piston cavity to close the at least one exhaust valve.

The compression-release brake system of the present invention is low cost and can be integrated into the overall engine design. Moreover, the present invention provides a compression-release brake system that is lightweight, does not mechanically and thermally overload the engine system, has quiet operation and yields optimum retarding power over the entire engine speed range where the engine brake is used.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In these drawings:

FIG. 2 is a fragmentary perspective view of an exhaust cam shaft and an exhaust rocker arm assembly according to the first exemplary embodiment of the present invention;

FIG. 3 is a perspective view of an exhaust rocker arm according to the first exemplary embodiment of the present invention with portions shown in phantom;

Figure 1:
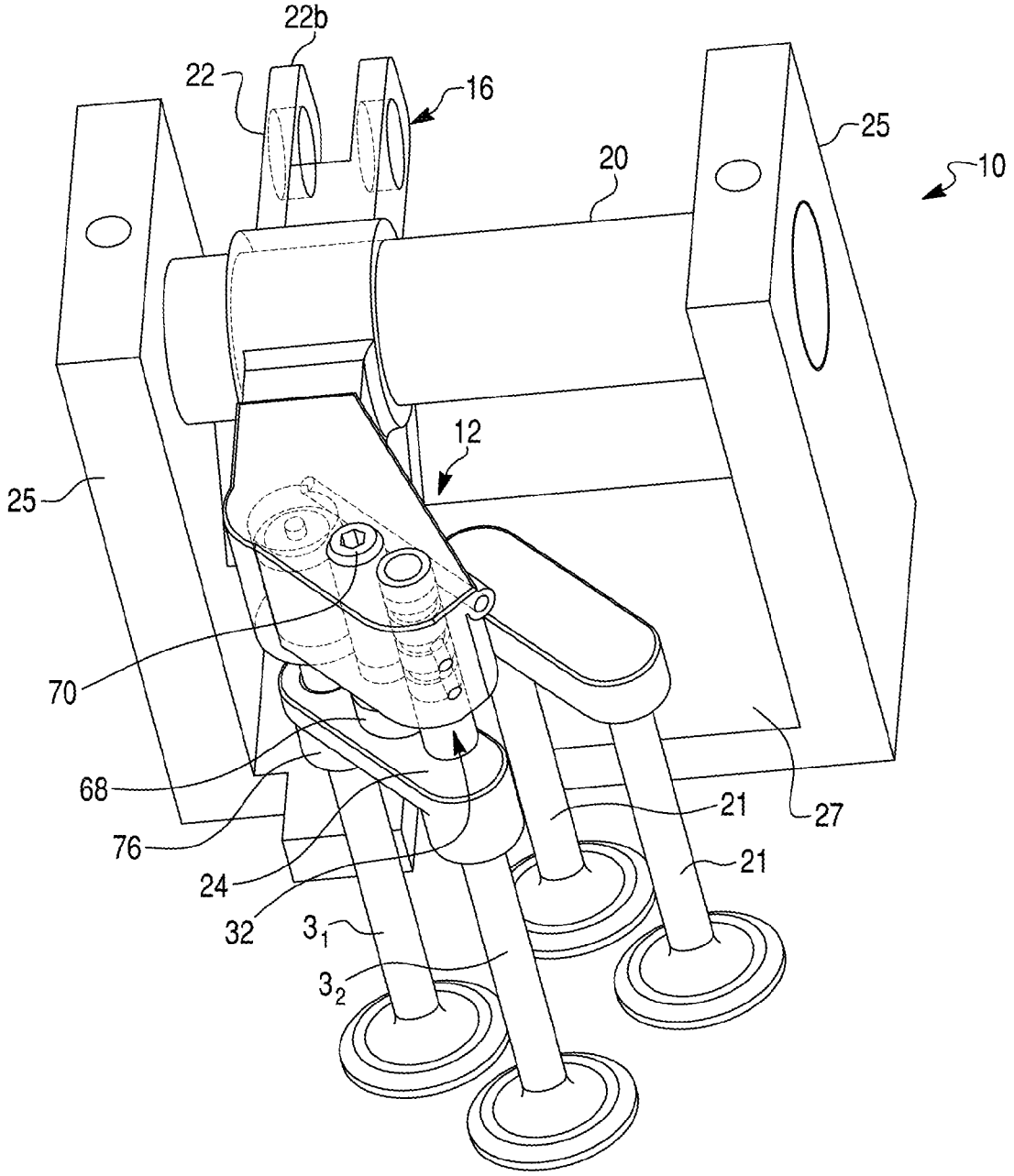
FIG. 1 is a perspective view of a valve train assembly including a rocker arm compression-release engine brake system according to a first exemplary embodiment of the present invention.

DETAILED DESCRIPTION OF EXEMPLARY EMBODIMENT(S) AND EMBODIED METHOD(S) OF THE INVENTION

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "front," "rear," "upper", "lower", "top" and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the words "a" and/or "an" as used in the claims mean "at least one".

In summary, embodiments disclosed herein utilize a reset mechanism carried by or integrated into an engine rocker arm which actuates one of two exhaust valves. The exhaust valve reset device eliminates the opening of an unbalanced exhaust valve bridge and additionally minimizes exhaust/intake valve overlap near the start of the intake stroke. Actuating one of two exhaust valves results in reducing valve train loading and provides the ability to delay exhaust valve opening resulting in increased charge for better braking performance. The reduced valve overlap increases exhaust manifold back pressure by reducing the exhaust manifold air mass from flowing back into the intake manifold. The increased exhaust stroke pressure creates additional engine work by the engine brake during the exhaust stroke. Extended valve overlap causes an undesired exhaust manifold air mass flow into the engine intake system, thus reducing exhaust stroke work and decreasing braking performance.

During brake operation, a reset check valve in the reset device is hydraulically locked due to the increasing cylinder pressure during the compression stroke. As the cylinder pressure drops after top dead center of the compression stroke, the hydraulic pressure applied to the reset check valve begins to correspondingly fall. Eventually the hydraulic pressure drops sufficiently so that a biasing force applied to the reset check valve overcomes the hydraulic force and the reset check valve opens and allows engine oil to flow and thus resets the exhaust valve and allows both exhaust valves to move during the exhaust cycle.

FIGS. 1-12 illustrate a first exemplary embodiment of a valve train assembly of an internal combustion engine, generally depicted by the reference character 10. The valve train assembly 10 includes a rocker arm compression-release engine brake system 12 according to the first exemplary embodiment of the present invention, provided for an internal combustion (IC) engine. Preferably, the IC engine is a four-stroke diesel engine, comprising a cylinder block including a plurality of cylinders. However, for the sake of simplicity, the valve train assembly 10 for only one cylinder is shown in FIG. 1. Each cylinder is provided with a piston that reciprocates therein. Each cylinder is further provided with at least one intake valve and at least one exhaust valve, each provided with a return spring and a valve train provided for lifting and closing the intake and exhaust valves. The IC engine is capable of performing a positive power operation (normal engine cycle) and an engine brake operation (engine compression-release brake cycle). The compression-release brake system 12 operates in a compression brake mode or brake-on mode (during the engine compression brake operation) and a compression brake deactivation mode, or brake-off mode (during the positive power operation). A switch in the vehicle cab is typically used to shift between modes and to control fuel flow to the cylinders depending upon the mode.

The rocker arm compression-release engine brake system 12 according to the exemplary embodiment of the present invention is a lost motion engine brake system that, as best shown in FIG. 2, incorporates an exhaust cam 2 with a normal (conventional) engine exhaust cam profile 6, an engine brake lift profile 7 for a compression-release engine braking event during the engine brake operation, and a pre-charge lift profile 8. The cam lift profiles 7 and 8 are stylized for purposes of explanation. The normal engine powering mode (i.e., the normal engine cycle) incorporates sufficient clearance in the exhaust valve train to eliminate the additional cam lift profiles 7 and 8 during normal positive power engine operation.

The rocker arm compression-release engine brake system 12 according to the first exemplary embodiment of the present invention includes a conventional intake rocker assembly (not shown) for operating two intake valves 1, and a lost motion exhaust rocker assembly 16 for operating the exhaust valve(s). The exhaust rocker assembly 16 according to the first exemplary embodiment of the present invention is of a lost motion type provided with automatic hydraulic adjusting and resetting functions. The exhaust rocker assembly 16 includes an exhaust rocker arm 22 pivotally mounted about a rocker shaft 20 and provided to open first and second exhaust valves $\mathbf{3}_1$ and $\mathbf{3}_2$, respectively, through an exhaust valve bridge 24. The rocker shaft 20 is supported by rocker arm supports (or rocker arm pedestals) 25 and extends through a rocker arm bore 33 formed in the exhaust rocker arm 22 (as best shown in FIGS. 1, 3 and 5B). The rocker arm pedestals 25 are in turn mounted to a pedestal support 27.

The exhaust rocker arm 22, as best shown in FIG. 3, has two ends: a driving (first distal) end 22*a* controlling the engine exhaust valves $\mathbf{3}_1$ and $\mathbf{3}_2$ and a driven (second distal) end 22*b* adapted to contact an exhaust cam 2, which is mounted to a rotating exhaust camshaft 4 (as best shown in FIG. 2). The exhaust cam 2 is provided with an exhaust lift profile 6, an engine brake lift profile 7 and a pre-charge lift profile 8.

The driven end 22*b* of the exhaust rocker arm 22 includes an exhaust cam lobe follower 21, as best shown in FIG. 2. The exhaust cam lobe follower 21 is adapted to contact the exhaust lift profile 6, the engine brake lift profile 7 and the pre-charge lift profile 8 of the exhaust cam 2.

Figure 4:
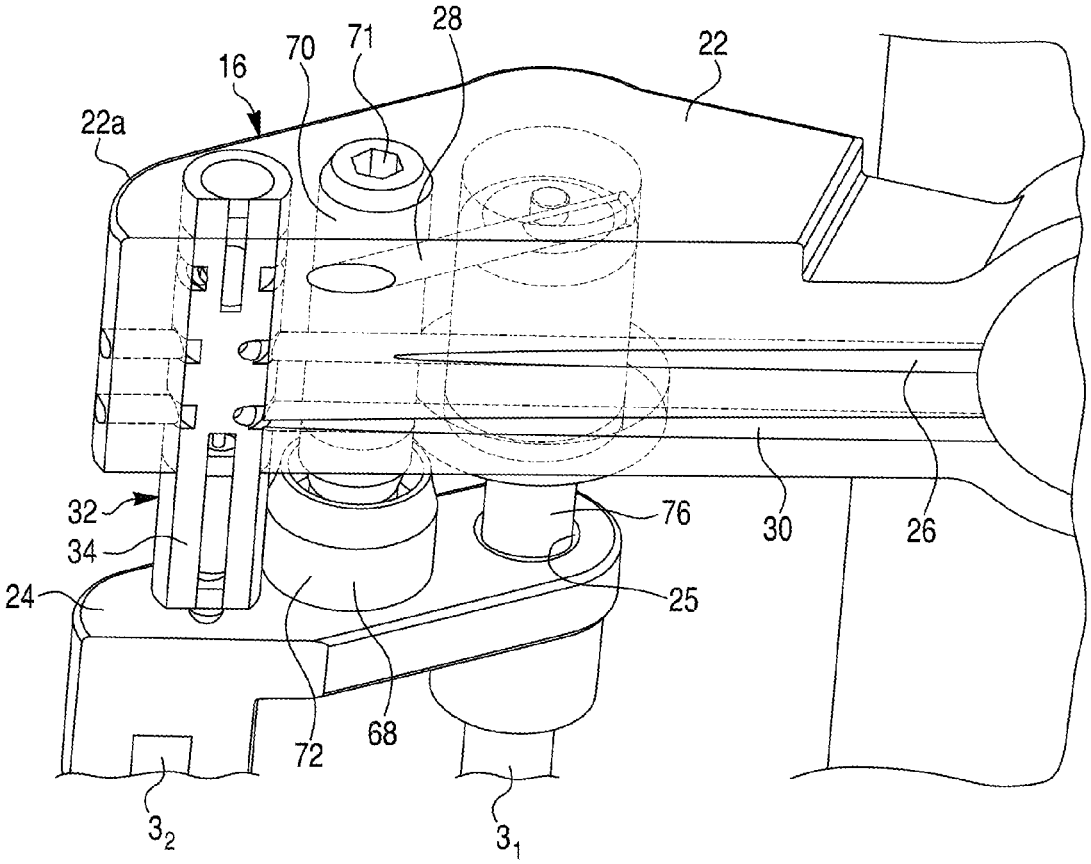
FIG. 4 is a partial perspective view of the rocker arm compression-release engine brake system according to the first exemplary embodiment of the present invention with portions shown in phantom.

Moreover, the exhaust rocker arm 22 also includes a rocker arm adjusting screw assembly 68 (as best shown in FIGS. 1, 3 and 4) adjustably, such as threadedly, mounted in a substantially cylindrical threaded screw bore 23*a* in the driving end 22*a* of the exhaust rocker arm 22. As best illustrated in FIGS. 1, 3 and 4, the rocker arm adjusting screw 68 is provided to engage the exhaust valve bridge 24 in order to open the exhaust valves $\mathbf{3}_1$ and $\mathbf{3}_2$. The rocker arm adjusting screw 68 includes an adjustment screw 70 adjustably, such as threadedly, mounted in the substantially cylindrical threaded screw bore 23*a* in the driving end 22*a* of the exhaust rocker arm 22, and a contacting (so called "elephant") foot 72 swivelably mounted on one end of the adjustment screw 70 adjacent to the exhaust valve bridge 24.

The adjustment screw 70 is provided with a hexagonal socket 71 accessible from above the exhaust rocker arm 22 for setting a predetermined valve lash (or clearance) δ between the contacting foot 72 of the adjusting screw 68 and the exhaust valve bridge 24 when the exhaust rocker roller follower 21 is in contact with a lower base circle 5 on the exhaust cam 2, i.e., when the exhaust cam 2 is not acting (pressing) on the exhaust rocker arm 22. The predetermined valve lash δ is set to provide a normal exhaust valve motion in a positive power operation with clearance for valve train component growth at engine operating temperatures. In an engine brake operation all lash (except the predetermined valve lash δ) is removed from the valve train and the brake cam profile determines the opening timing, profile and lift of the exhaust valves.

The lost motion engine brake rocker arm assembly 16 is part of the rocker arm compression-release engine brake system 12 provided for the internal combustion (IC) engine. Pressurized hydraulic fluid, such as engine oil, is supplied to the exhaust rocker arm 22 under high pressure through a high pressure hydraulic circuit, as best illustrated in FIGS. 1-3, to remove valve train lash (except the predetermined valve lash δ). As best illustrated in FIG. 4, the high pressure hydraulic circuit includes a continuous supply conduit (or passageway) 26, a high-pressure conduit 28 and a brake-on supply conduit 30. The brake-on supply conduit 30 is controlled by a solenoid valve, not shown, that selectively operates to supply the pressurized hydraulic fluid to the brake-on conduit 30.

The exhaust rocker arm 22 further includes a substantially cylindrical actuation piston bore 64 (best shown in FIGS. 3 and 4) formed in the exhaust rocker arm 22 at the driving end 22*a* thereof for slidably receiving an actuation piston 62 (best shown in FIGS. 5A and 5B) therein. The actuation piston 62 is moveable between refracted and extended positions relative to the actuation piston bore 64 and is adapted to contact a top end surface 76*a* of a single-valve actuation pin 76 (best shown in FIGS. 5A, 5B and 6B). The single-valve actuation pin 76 is slidably movable relative to the exhaust valve bridge 24 through an opening 25 in the exhaust valve bridge 24 (best shown in FIG. 6A).

Figure 5A:
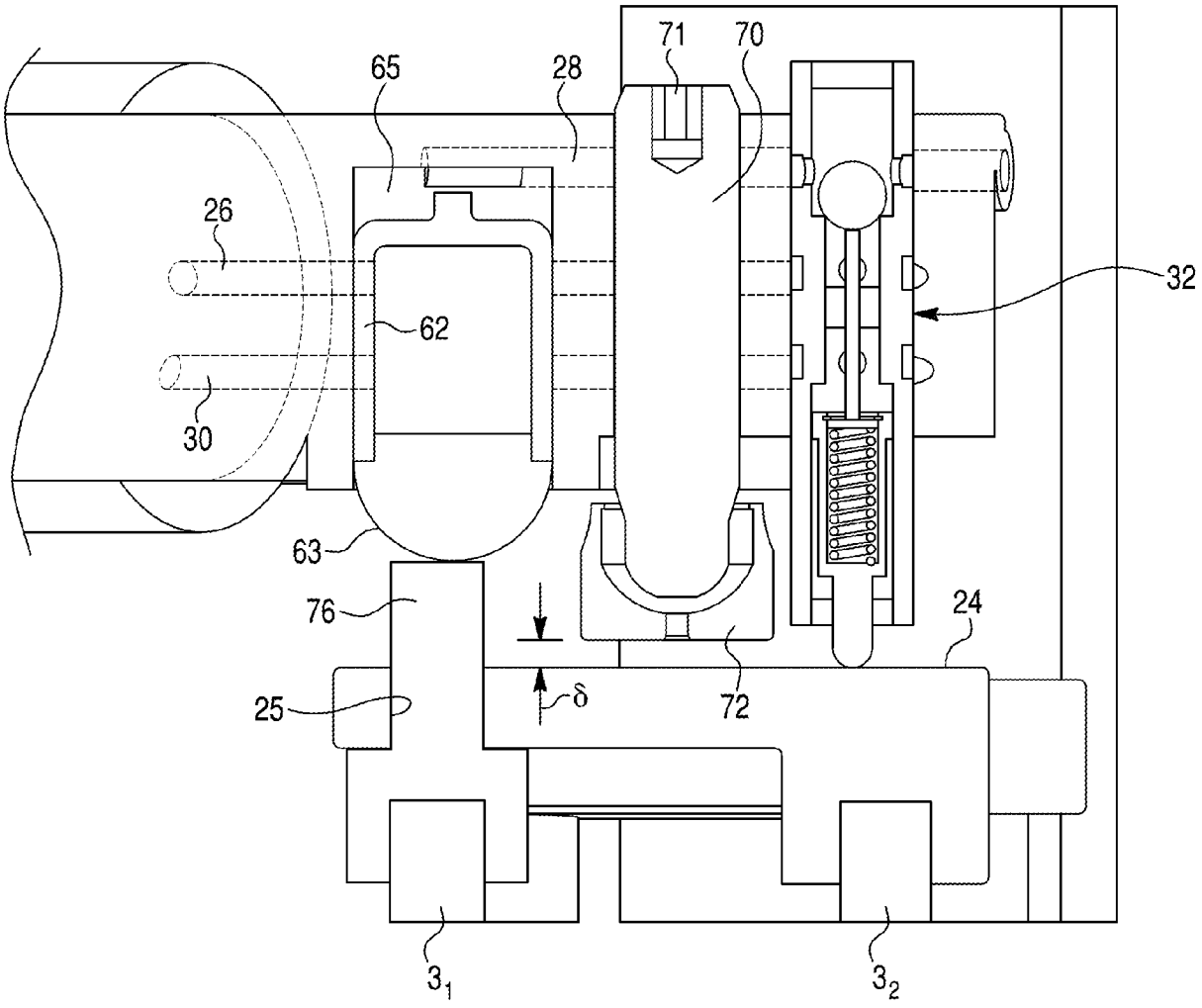
FIG. 5A is a fragmentary sectional view of the rocker arm compression-release engine brake system according to the first exemplary embodiment of the present invention in a brake-on mode.
Figure 5B:
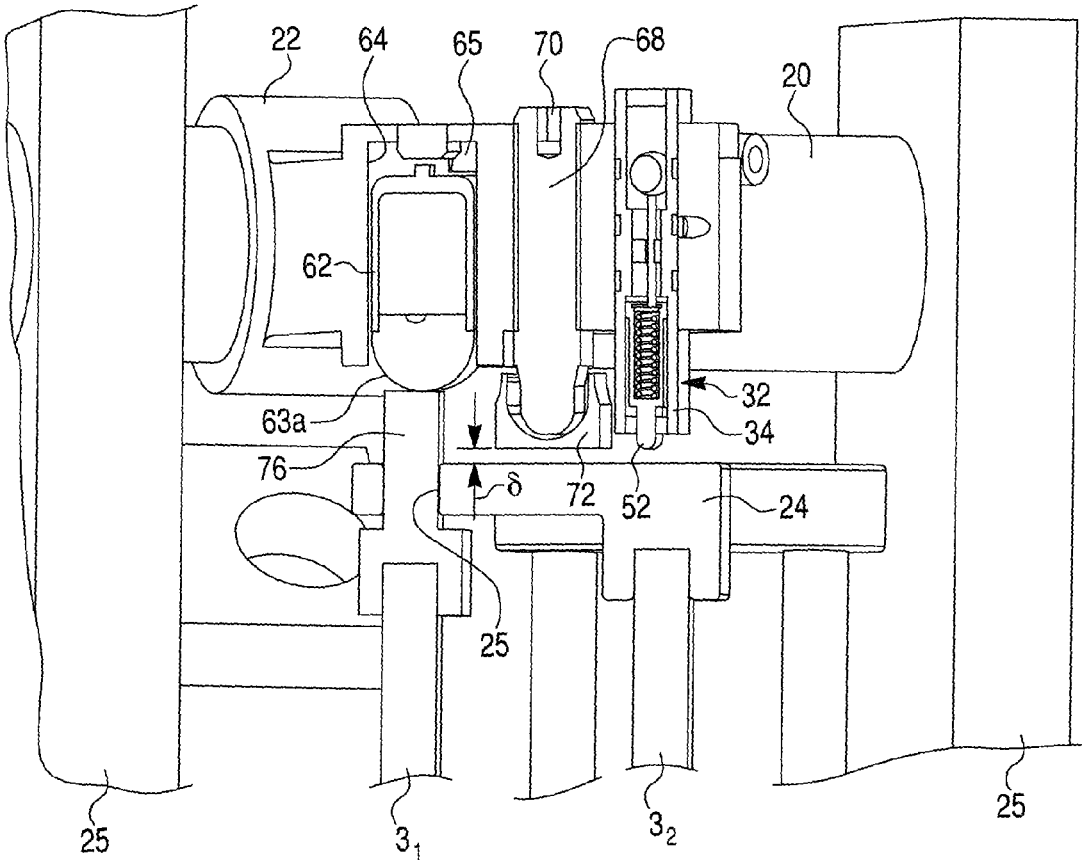
FIG. 5B is a fragmentary sectional view of the rocker arm compression-release engine brake system according to the first exemplary embodiment of the present invention in a brake-off mode.

The actuation piston 62 defines an actuation (or reset) piston cavity 65 within the actuation piston bore 64 in the exhaust rocker arm 22 (best shown in FIGS. 5A and 5B). The actuation piston 62, shown in detail in FIG. 7, includes a hemispherical bottom surface 63*a* provided to engage the single-valve actuation pin 76, and a rear extension 63*b* provided to contact a closed end of the actuation piston bore 64 so as to limit the rearward movement of the actuation piston 62 in the actuation piston bore 64 and prevent the actuation piston 62 from covering a hole in the actuation piston bore 64 fluidly connecting the actuation piston cavity 65 with the high-pressure conduit 28. In the extended position the rear extension 63*b* of the actuation piston 62 is spaced from the closed end of the actuation piston bore 64 by a piston clearance $k_1$ (shown in FIGS. 5C and 14), such as 0.15".

Moreover, the semi-spherical bottom surface 63*a* of the actuation piston 62 of the exhaust rocker arm 22, which faces the exhaust valve bridge 24, is adapted to contact the top end surface 76*a* of the single-valve actuation pin 76. A bottom end surface 76*b* of the single-valve actuation pin 76, axially opposite to the first surface 76*a* thereof, engages a proximal end of the first exhaust valve $\mathbf{3}_1$. The exhaust single-valve actuation pin 76 allows the actuation piston 62 to press against the first exhaust valve $\mathbf{3}_1$ to open the first exhaust valve $\mathbf{3}_1$ (only one of the two exhaust valves 3) during the compression-release engine braking operation (i.e., in the brake-on mode). In other words, the single-valve actuation pin 76 is reciprocatingly movable relative to the exhaust valve bridge 24 so as to make the first exhaust valve $\mathbf{3}_1$ movable relative to the second exhaust valve $\mathbf{3}_2$ and the exhaust valve bridge 24. Consequently, a bridge surface 76*c* of the single-valve actuation pin 76 (best shown in FIG. 6B) is spaced from the exhaust valve bridge 24 by an actuation pin clearance $k_2$ (best shown in FIGS. 5C and 14), such as 0.05", during the compression-release engine braking event of the engine compression brake operation.

The rocker arm compression-release brake system 12 further comprises an exhaust valve reset device 32 disposed in the exhaust rocker arm 22. The reset device 32 according to the first exemplary embodiment of the present invention (shown in detail FIGS. 8-9B) is in the form of a substantially cylindrical, hollow cartridge and comprises a substantially cylindrical cartridge body 34 provided with an annular supply groove 36 fluidly connected with the continuous supply conduit 26, an annular brake-on groove 38 fluidly connected with the brake-on supply conduit 30, and an annular piston groove 40 fluidly connected with the high-pressure conduit 28. As best illustrated in FIGS. 1, 4, 5A and 5B, the cylindrical cartridge body 34 of the reset device 32 is disposed outboard of the adjusting screw assembly 68 at the driven (second distal) end 22*b* of the exhaust rocker arm 22. Alternatively, as illustrated in FIG. 10, the cartridge of the reset device 32 is located inboard of the adjusting screw assembly 68. An exhaust valve bridge $\mathbf{24}_1$ has a bridge extender $\mathbf{24}_{12}$ for trigger contact. As further shown in FIG. 10, the elongated distal end 52 of the reset trigger 50 is in contact with the bridge extender $\mathbf{24}_{12}$ of the exhaust valve bridge $\mathbf{24}_1$ when the reset trigger 50 is in the extended position. Thus, the cartridge of the reset device 32 can be located both inboard and outboard or parallel to the rocker shaft with a fixed cam profile to the rocker supports.

Each of the supply groove 36, the brake-on groove 38 and the piston groove 40 are formed on an outer peripheral cylindrical surface of the cartridge body 34 and axially spaced from each other. Moreover, the supply groove 36 is provided with at least one continuous supply port 37 through the cartridge body 34, the brake-on groove 38 is provided with at least one brake-on supply port 39 through the cartridge body 34, while the piston groove 40 is provided with at least one piston supply port 41 through the cartridge body 34. The cylindrical cartridge body 34 is non-movably disposed within a substantially cylindrical reset bore 23*b* in the exhaust rocker arm 22. Thus, the high-pressure conduit 28 fluidly connects the actuation piston bore 64 with the piston groove 40 of the cartridge body 34 of the reset device 32. An inner cavity 42 within the cylindrical cartridge body 34 is enclosed between an upper cartridge plug 35*a* and a lower cartridge plug 35*b*. In other words, the annular grooves 36, 38 and 40 are fluidly connected to the inner cavity 42 of the cartridge body 34 through one or more ports (or drillings) 37, 39 and 41. As best illustrated in FIGS. 4-5B, the cartridge body 34 is axially spaced from the exhaust valve bridge 24.

Figure 9A:
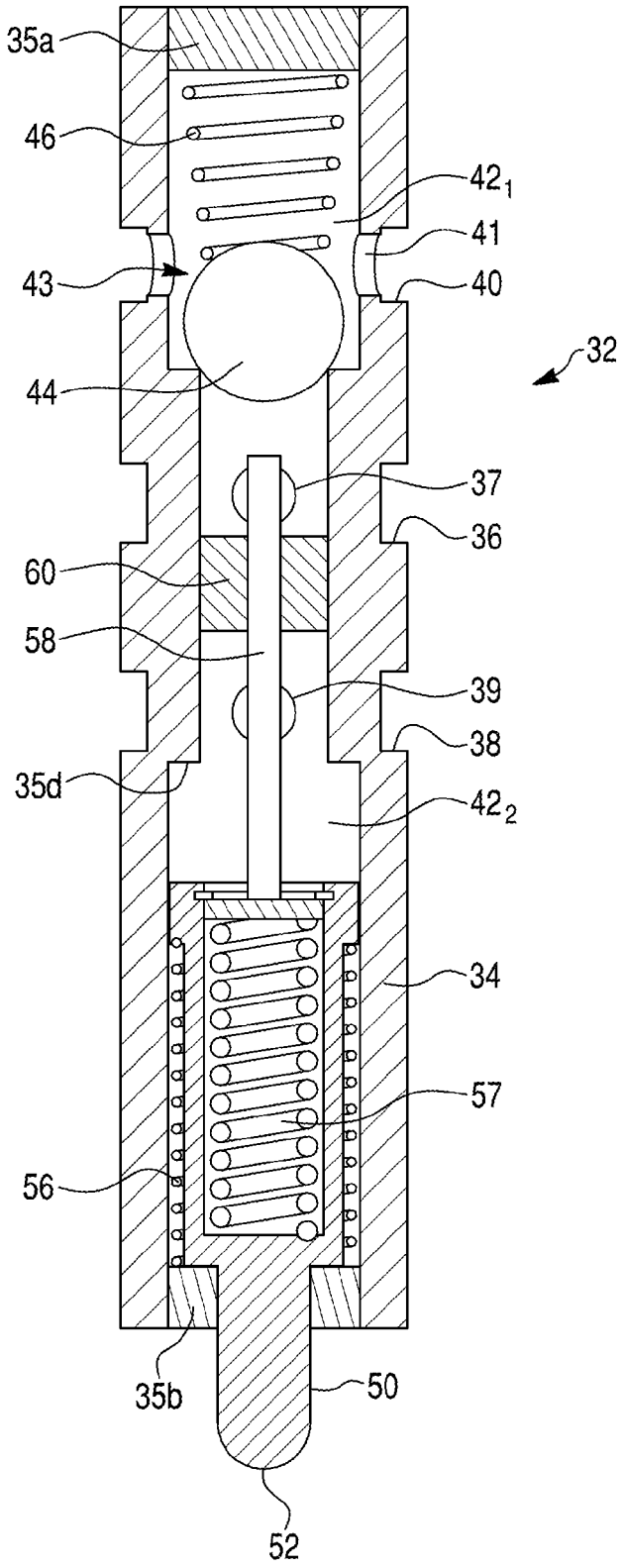
FIG. 9A is a sectional view of an exhaust valve reset device according to the first exemplary embodiment of the present invention in the brake-on mode.
Figure 9B:
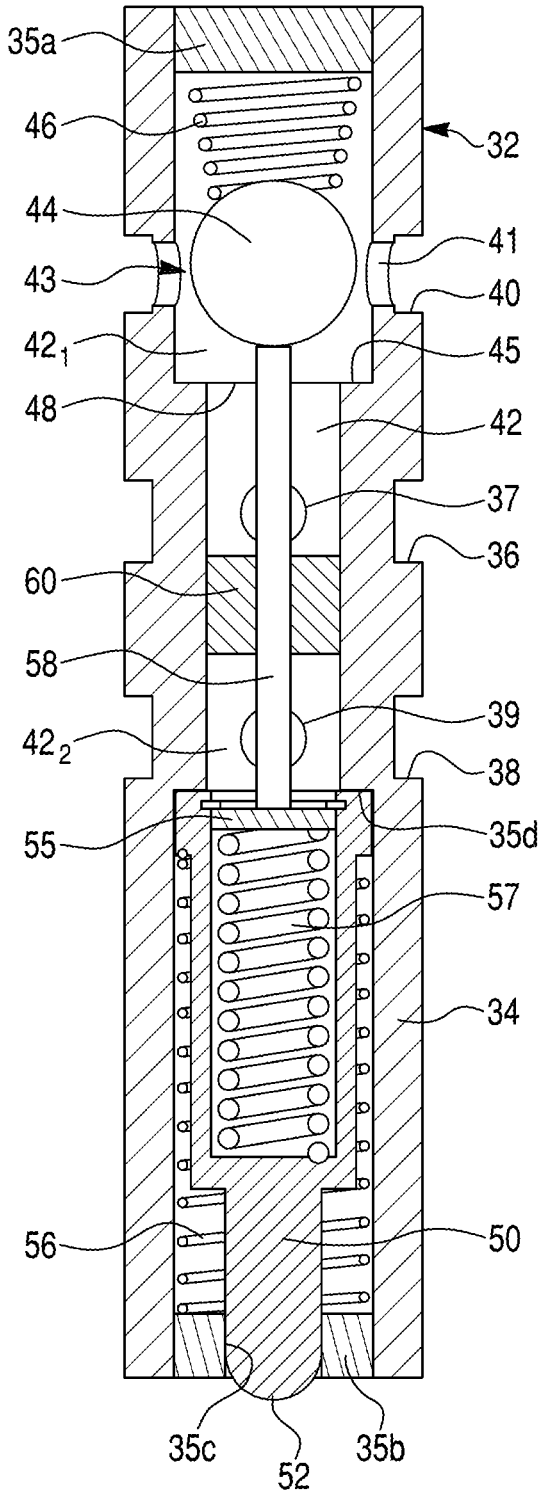
FIG. 9B is a sectional view of the exhaust valve reset device according to the first exemplary embodiment of the present invention in the brake-off mode.
Figure 10:
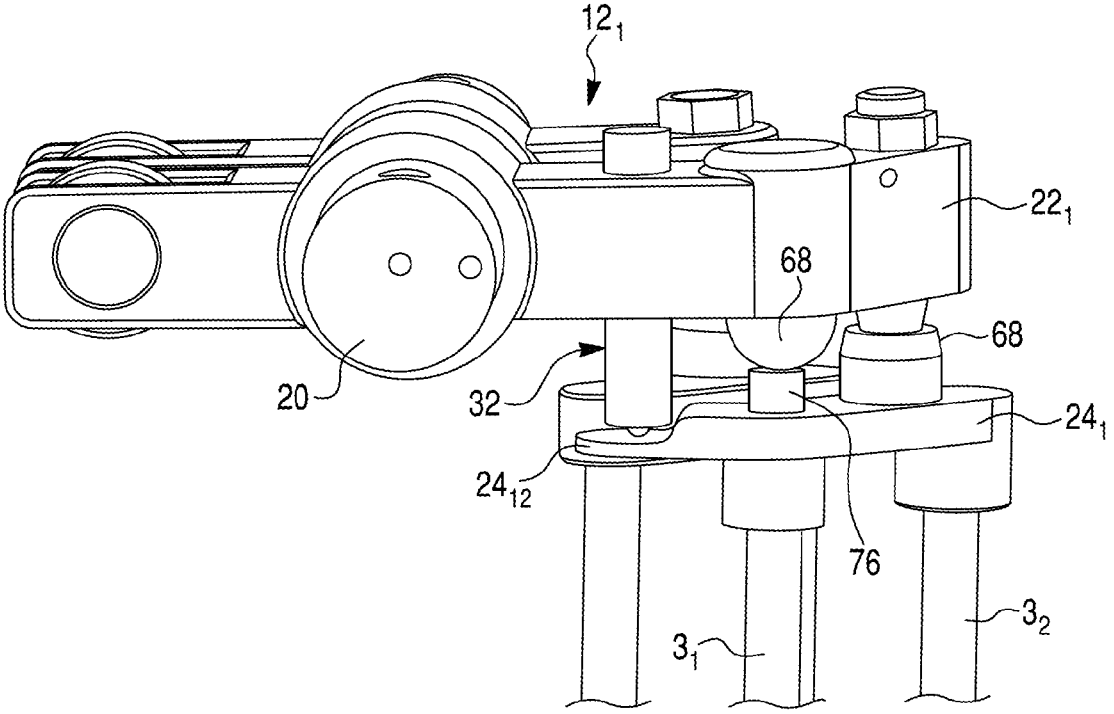
FIG. 10 is a perspective view of a valve train assembly including a rocker arm compression-release engine brake system according to an alternative to the first exemplary embodiment of the present invention.

The reset device 32, as best shown in FIGS. 9A and 9B, further comprises a ball-valve member 44, and a ball-check spring 46 disposed between the ball-valve member 44 and the upper cartridge plug 35*a*. The ball-valve member 44 is held on a check-ball seat 45 by a biasing spring force of the ball-check spring 46 so as to close communication port 48 in the cartridge body 34, which fluidly connects the continuous supply port 37 and the piston supply port 41 of the cartridge body 34. The ball-valve member 44, the check-ball seat 45 and the ball-check spring 46 define a reset check valve 43 normally biased closed by the ball-check spring 46. The reset check valve 43 is disposed between the continuous supply conduit 26 and the actuation piston cavity 65, and provides selective fluid communication between the continuous supply conduit 26 and the high-pressure conduit 28. It will be appreciated that any appropriate type of the check valve is within the scope of the present invention.

The exhaust valve reset device 32 further comprises a reset trigger 50 axially slidable within the cartridge body 34. The reset trigger 50 has an elongated distal end 52 at least partially extending from the cartridge body 34 through a bore 35*c* in the lower cartridge plug 35*b*. The reset trigger 50 is movable relative to the cartridge body 34 between an extended position shown in FIGS. 5A and 9A, and a retracted position shown in FIGS. 5B and 9B. The reset trigger 50 is normally biased to the retracted position by a trigger return spring 56 disposed between a proximal end of the reset trigger 50 (axially opposite the distal end 52 thereof) and the lower cartridge plug 35*b*. Moreover, the reset trigger 50 is provided to lift, through the resilient biasing action of the trigger return spring 56, an upset pin 58, which contacts, lifts and holds the ball-valve member 44 off the check-ball seat 45 for all non-engine brake operations. An upper end of the upset pin 58 is disposed adjacent to the ball-valve member 44, while a lower end of the upset pin 58 engages the reset trigger 50 through a spring retainer 55 and a reset pressure spring 57 disposed inside the reset trigger 50 between the distal end 52 thereof and the spring retainer 55. Specifically, the upset pin 58 lifts and holds the ball-valve member 44 open (i.e., off the check-ball seat 45) when the reset trigger 50 is in the retracted position thereof (as best shown in FIG. 5A). On the other hand, in the extended position of the reset trigger 50 (shown in FIG. 5B), the ball-valve member 44 is returned to a closed position and held on the check-ball seat 45 by the biasing force of the ball-check spring 46 so as to close the communication port 48 in the cartridge body 34, and thus fluidly disconnect the continuous supply port 37 and the piston supply port 41 of the cartridge body 34. As further shown in FIG. 5A, the elongated distal end 52 of the reset trigger 50 is in contact with the exhaust valve bridge 24 when the reset trigger 50 is in the extended position thereof. Moreover, when the reset trigger 50 is in the extended position, the reset trigger 50 engages the lower cartridge plug 35*b*, which limits the outward axial movement of the reset trigger 50 in the direction toward the exhaust valve bridge 24. However, when the reset trigger 50 is in the retracted position thereof, the elongated distal end 52 of the reset trigger 50 is axially spaced from the exhaust valve bridge 24, as best illustrated in FIG. 5B.

The trigger return spring 56 biases the reset trigger 50 upward to a counter-bore stop 35*d* in the cartridge body 34. The pressure spring 57, used only in the engine brake-on mode, has a higher spring force than the conical ball-check spring 46 enabling the upset pin 58 to keep the ball check 44 off the check-ball seat 45, thus allowing oil from the continuous supply conduit 26 to flow unrestricted into and out of the actuation piston cavity 65 to remove the actuation piston lash during the positive power engine operation to eliminate valve train clatter.

As best illustrated in FIGS. 9A and 9B, the upset pin 58 extends through a guide pin sleeve 60 supporting and guiding the reciprocal, linear movement of the upset pin 58. As further illustrated in FIGS. 9A and 9B, the inner cavity 42 of the cartridge body 34 is divided by the guide pin sleeve 60 into a check-valve cavity $\mathbf{42}_1$ and a reset cavity $\mathbf{42}_2$. According to the first exemplary embodiment of the present invention, the reset cavity $\mathbf{42}_2$ is in fluid communication with the brake-on oil supply conduit 30 through the brake-on groove 38 and the brake-on supply port 39. In turn, the reset check valve 43 selectively provides fluid communication between the continuous supply conduit 26 and the high-pressure conduit 28, i.e., between the continuous supply conduit 26 and the actuation piston cavity 65.

Figure 5C:
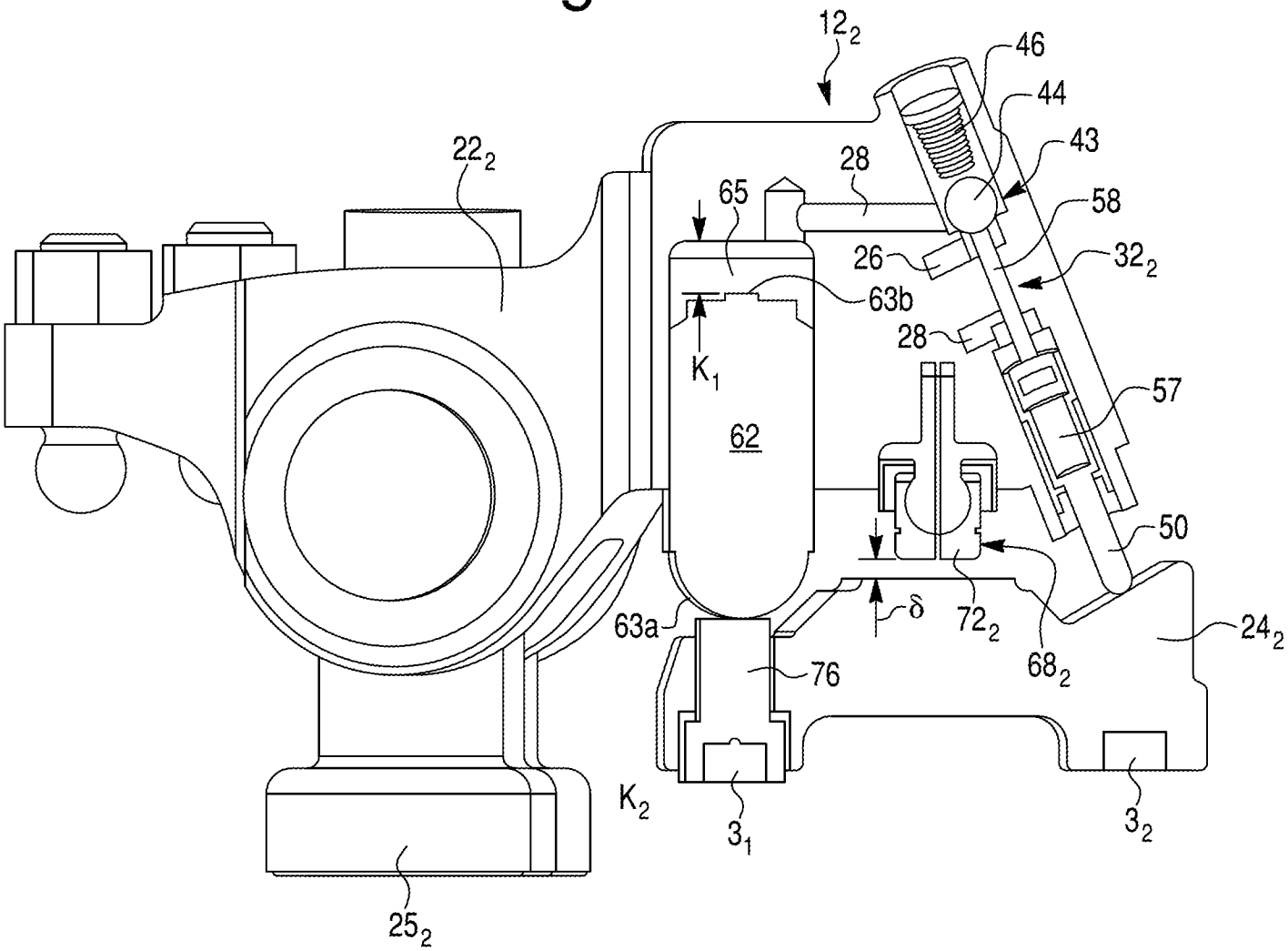
FIG. 5C is a fragmentary sectional view of the rocker arm compression-release engine brake system according to alternative exemplary embodiment of the present invention in a brake-off mode.

FIG. 5C illustrates an alternative embodiment of a rocker arm compression-release engine brake system $\mathbf{12}_2$. The rocker arm compression-release engine brake system $\mathbf{12}_2$ is structurally and functionally substantially similar to the compression-release engine brake system 12 according to the first exemplary embodiment, and differs by a reset device $\mathbf{32}_2$. The alternative reset device $\mathbf{32}_2$ is structurally substantially similar to the reset device 32 according to the first exemplary embodiment. A difference between these two reset devices is that the alternative reset device $\mathbf{32}_2$, contrary to the reset device 32 according to the first exemplary embodiment, does not include the cylindrical cartridge body 34 of the reset device 32 disposed within the cylindrical reset bore 23*b* in the exhaust rocker arm 22. Instead, the reset device $32_2$ is machined directly into a rocker arm $22_2$, as illustrated in FIG. 5C. In other words, the cylindrical reset bore 23*b* in the exhaust rocker arm $22_2$ is machined to imitate the cartridge body 34 of the reset device 32. The alternative reset device $32_2$ operates substantially similarly to the reset device 32 according to the first exemplary embodiment.

Figure 5D:
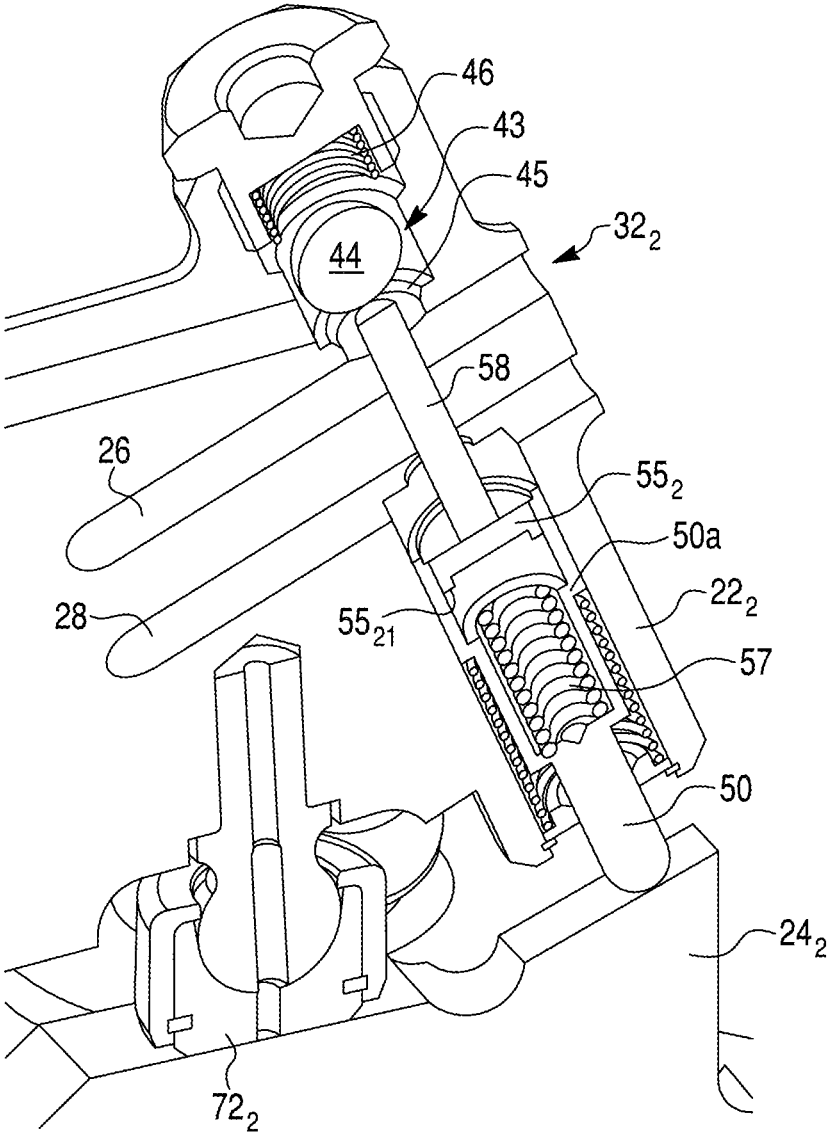
FIG. 5D is an enlarged fragmentary sectional view of a reset device of the rocker arm compression-release engine brake system of FIG. 5C.
Figure 6A:
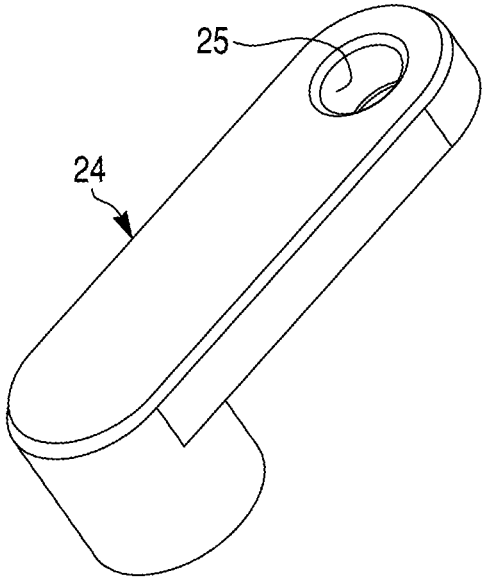
FIG. 6A is a perspective view of an exhaust valve bridge according to the first exemplary embodiment of the present invention.
Figure 6B:
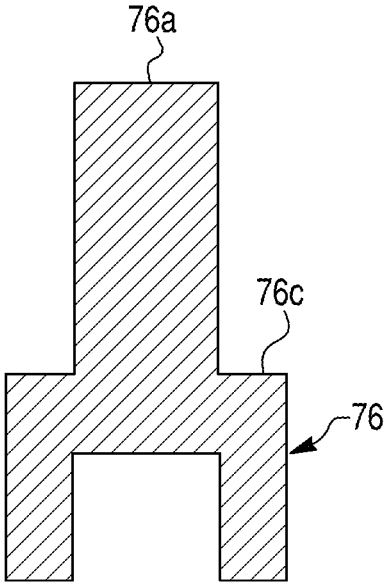
FIG. 6B is a sectional view of a single-valve actuation pin according to the first exemplary embodiment of the present invention.
Figure 8:
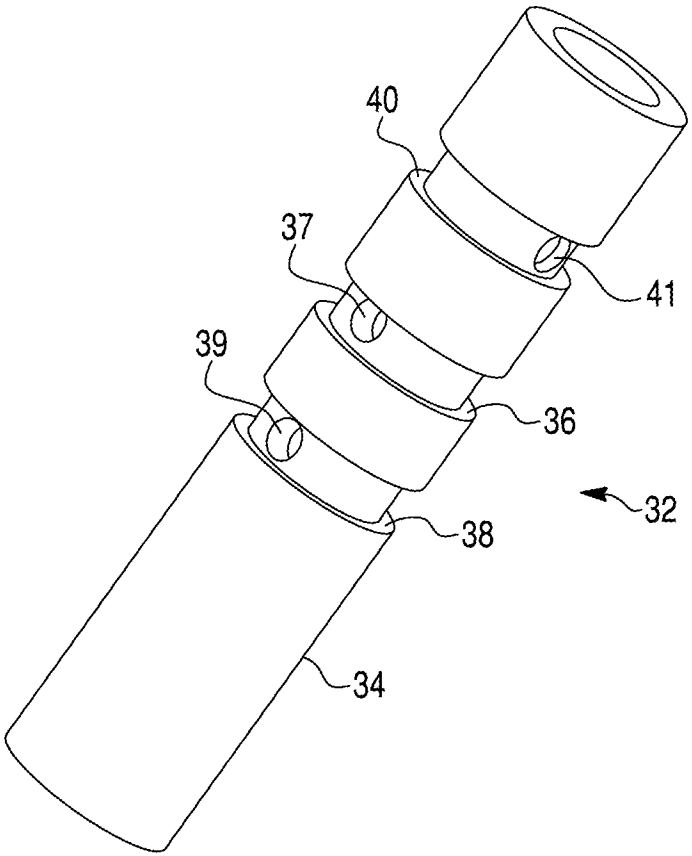
FIG. 8 is a perspective view of a cartridge body according to the first exemplary embodiment of the present invention.
Figure 7:
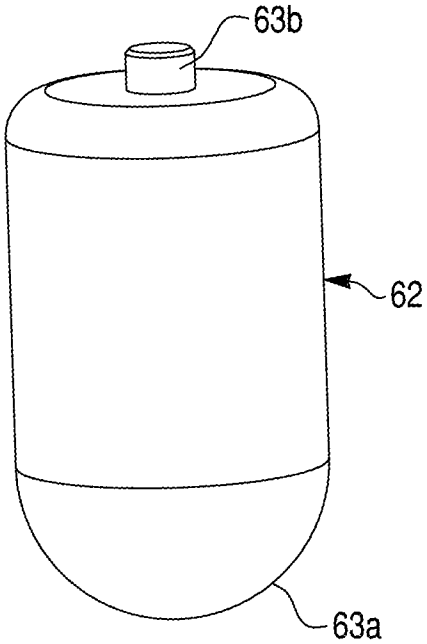
FIG. 7 is a perspective view of an actuation piston according to the first exemplary embodiment of the present invention.

As further illustrated in FIG. 5D, a reset trigger 50 of the reset device $32_2$ has an annular internal stop portion 50*a* facing a cup-shaped spring retainer $55_2$. In turn, the spring retainer $55_2$ has an annular stop portion $55_{21}$ facing the internal stop portion 50*a* of the reset trigger 50. The stop portion 50*a* of the reset trigger 50 and the stop portion $55_{21}$ of the spring retainer $55_2$ define a reset failsafe mechanism provided for protecting against failure of the pressure spring 57 internal to the reset trigger 50 resulting in the single engine brake exhaust valve $3_1$ not being reset prion to the normal exhaust motion resulting in an unbalanced exhaust valve bridge and possible engine damage.

Specifically, the stop portion $55_{21}$ of the spring retainer $55_2$ defines a mechanical stop activated by exceeding addition upward stroke of the reset trigger 50 than normal maximum stroke of the reset trigger 50. This additional stroke of the reset trigger 50 would occur should the pressure spring 57 fail and do not force the ball check 44 off its seat 45 and the single engine brake exhaust valve $3_1$ does not reset prior to normal exhaust valve lift with a balanced bridge. The additional stroke of the elephant foot $72_2$ pressing on a center of the exhaust valve bridge $24_2$ results in a small unbalance of the exhaust valve bridge $24_2$ until the addition of the trigger stroke resulting from the rocker rotation during the normal exhaust valve motion forces the stop portion $55_{21}$ of the spring retainer $55_2$ to contact the internal stop portion 50*a* of the reset trigger 50. Then the reset trigger 50 through the upset pin 58 mechanically forces the ball check 44 off the seat 45 of the reset check valve 43 during the beginning of the exhaust valve stroke. This mechanical forcing of the ball check 44 off its seat 45 during the beginning of the normal exhaust lift profile continues until engine brake operation.

Figure 11A:
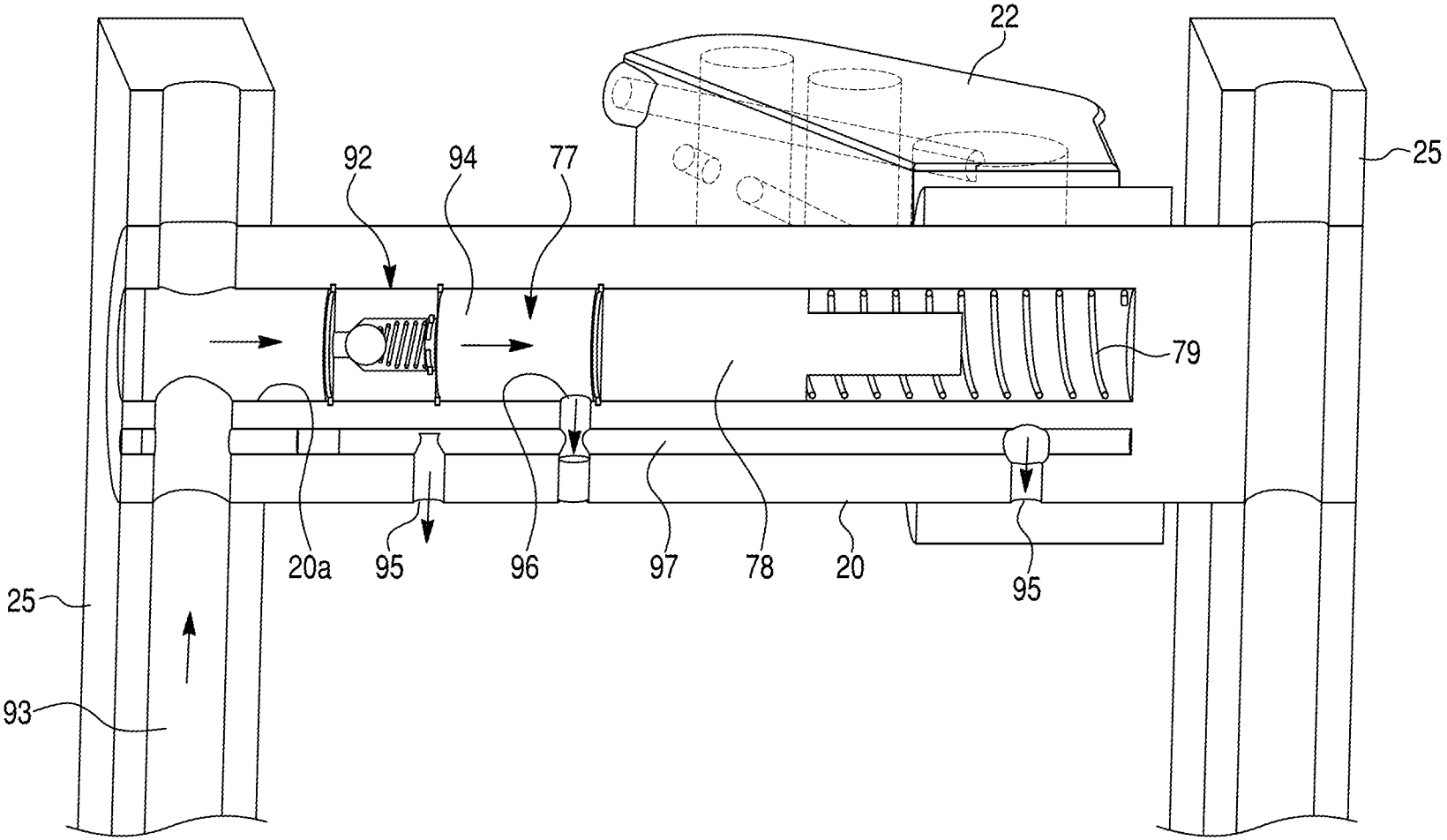
FIG. 11A shows pressurized hydraulic fluid supply to the rocker arm compression-release engine brake system according to the exemplary embodiment of the present invention with portions shown in phantom.
Figure 11B:
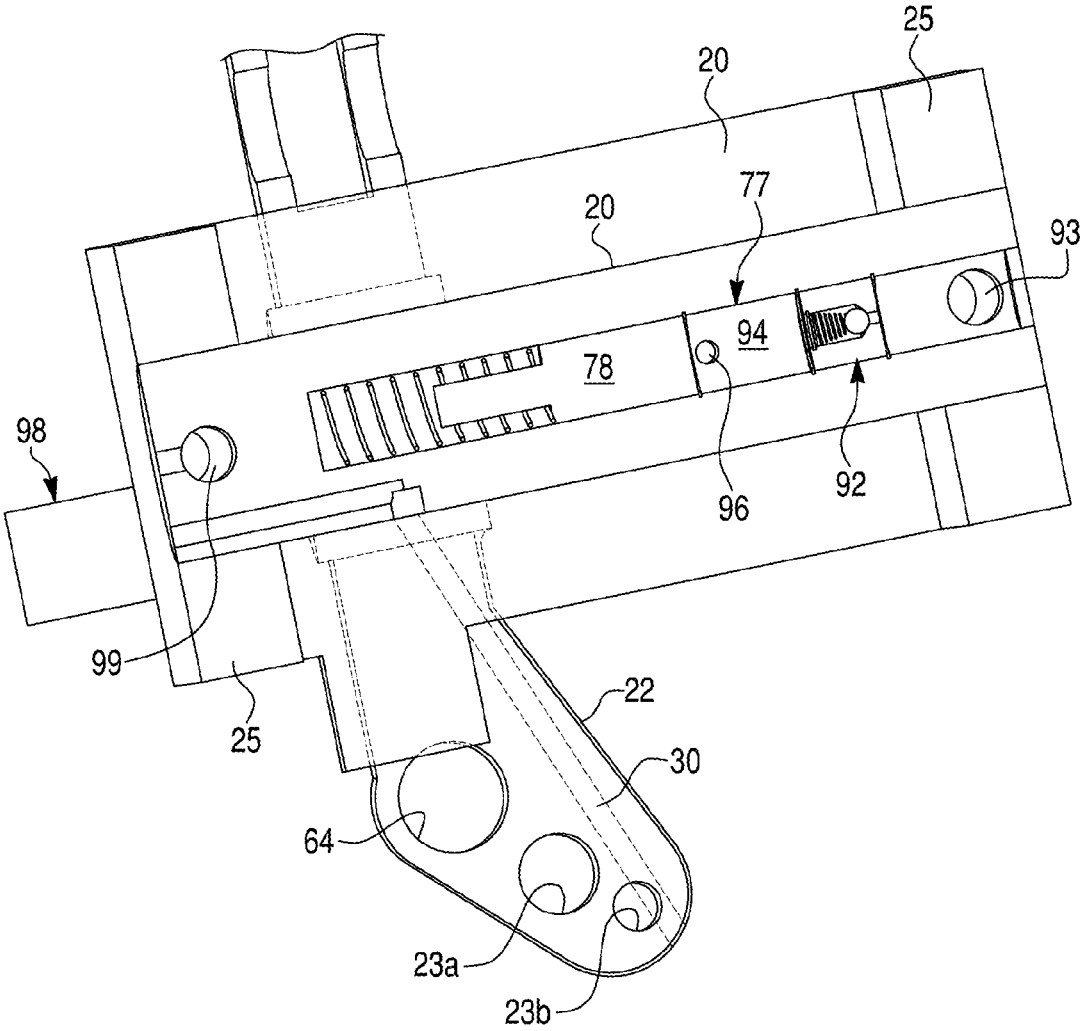
FIG. 11B is an alternative view of the pressurized hydraulic fluid supply to the rocker arm compression-release engine brake system according to the exemplary embodiment of the present invention with portions shown in phantom.

The rocker shaft 20 according the exemplary embodiment of the present invention, shown in FIGS. 11A and 11B, includes a substantially cylindrical accumulator bore 20*a* therein, and a rocker shaft accumulator 77. The rocker shaft accumulator 77 comprises a substantially cylindrical accumulator piston 78 slidingly movable within the accumulator bore 20*a*, an accumulator ball-check valve 92 and an accumulator cavity 94 defined between the accumulator piston 78 and the accumulator ball-check valve 92. The accumulator piston 78 is spring loaded by an accumulator spring 79 so as to be biased toward the accumulator ball-check valve 92. The accumulator ball-check valve 92 is oriented so as to allow the hydraulic fluid only into the accumulator cavity 94, but prevents flow of the hydraulic fluid from the accumulator cavity 94 through the accumulator ball-check valve 92. In other words, the accumulator ball-check valve 92 prevents oil flow back into oil supply. The accumulator ball-check valve 92 is biased in a closed position thereof by a ball check spring. The rocker shaft accumulator 77 stores the return hydraulic fluid under pressure for next refilling of the actuation piston cavity 65 for next engine exhaust cam motion.

As further shown in FIGS. 11A-11D, pressurized hydraulic fluid is supplied through a hydraulic fluid supply passage 93 formed in one or more of the rocker arm supports 25 (preferably, in hold down bolts of the rocker arm supports 25). The hydraulic fluid supply passage 93 is fluidly connected to the accumulator bore 20*a*. The rocker shaft 20 further includes a connecting passage 97 fluidly connected to the accumulator cavity 94 through a connecting port 96. The connecting passage 97 is provided with at least one supply port 95 fluidly connected to the continuous supply conduit 26 in the exhaust rocker arm 22.

In operation, the pressurized hydraulic fluid is supplied to the accumulator cavity 94 through the supply passage 93 and the accumulator ball-check valve 92. Then, the pressurized hydraulic fluid flows from the accumulator cavity 94 to the continuous supply conduit 26 of the exhaust rocker arm 22 through the connecting port 96, the connecting passage 97 and the supply port 95. During engine braking reset operation, the pressurized hydraulic fluid is dumped back into the rocker shaft accumulator cavity 94. The accumulator ball-check valve 92 prevents hydraulic fluid flow back into the hydraulic fluid supply passage 93.

Figure 11C:
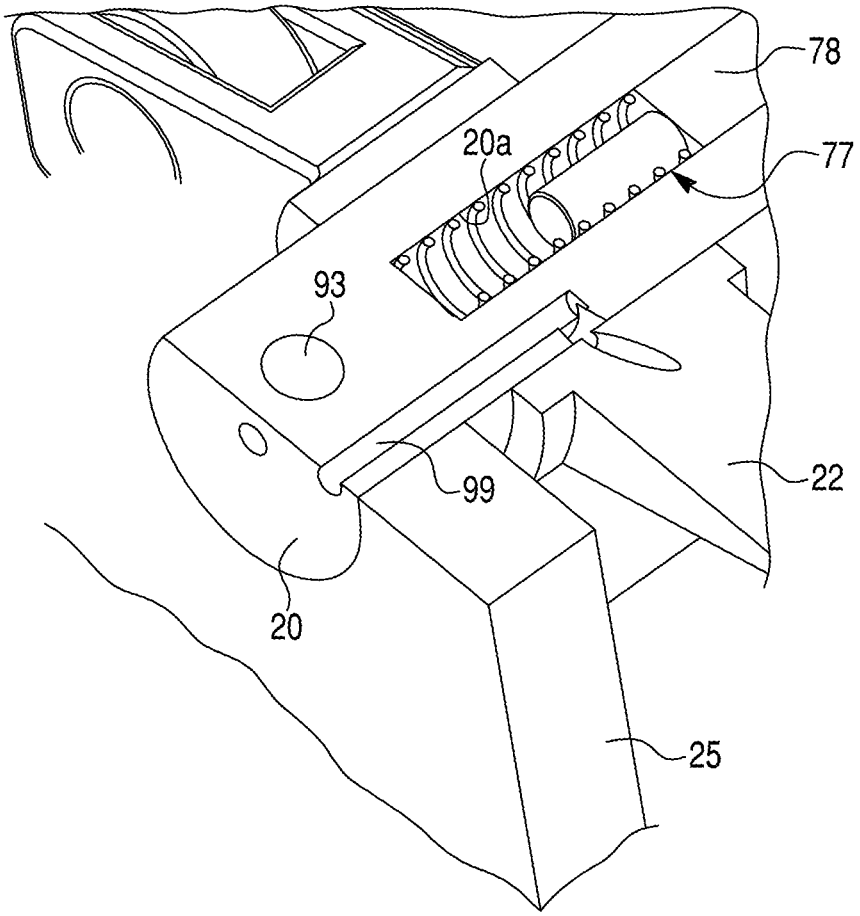
FIG. 11C is a perspective view of a rocker arm pedestal supporting a rocker shaft.
Figure 11D:
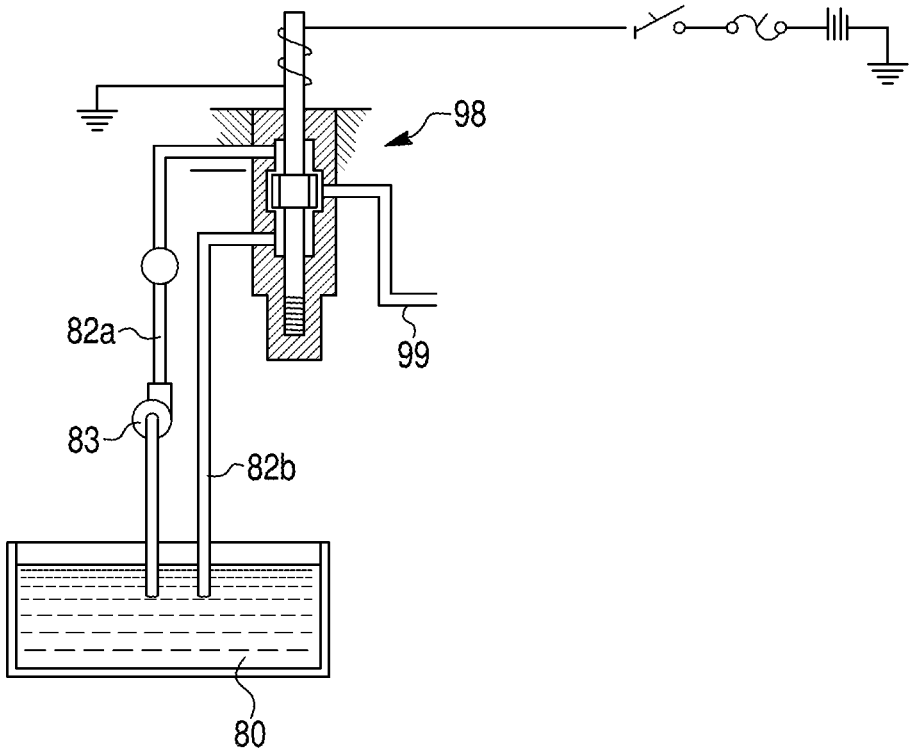
FIG. 11D is a schematic view of brake-on supply passageway.

The rocker arm compression-release brake system 12 further comprises an on-off solenoid valve 98, shown in FIGS. 11B and 11D, selectively providing the brake-on supply conduit 30 of the rocker arm compression-release brake system 12 with the pressurized hydraulic fluid. The brake-on pressurized hydraulic fluid is selectively supplied to the brake-on supply conduit 30 through operation of the on-off solenoid valve 98 mounted on one of the rocker arm pedestals 25, and a brake-on oil supply passage 99 formed in the exhaust rocker arm 22 and fluidly connected to the brake-on supply conduit 30, as best shown in FIGS. 11B and 11C. As further illustrated in FIG. 11D, the pressurized hydraulic fluid, such as engine oil, is supplied from a sump 80 to the on-off solenoid valve 98 by a fluid pump 83 through a brake supply passage 82*a*, and returned (or dumped) back to the sump 80 through a brake-off dump passage 82*b*.

The positive power operation of the engine is as follows. During the positive power operation, when the engine brake is not activated, the hydraulic fluid continuous supply conduit 26 provides continuous flow of hydraulic fluid, such as motor oil, to the check-valve cavity $42_1$ through the continuous supply groove 36 and the continuous supply port 37. Moreover, during the positive power operation, the reset trigger 50 is in the retracted position by the biasing force of the trigger return spring 56. In this position, the ball-valve member 44 is lifted off the check-ball seat 45 (to an open position of the reset check valve 43) by the reset trigger 50. Specifically, the reset trigger 50 lifts, through the resilient biasing action of the trigger return spring 56 and the upset pin 58, which contacts, lifts and holds the ball-valve member 44 off the check-ball seat 45 for all non-engine brake operation. As the reset check valve 43 is open, the pressurized hydraulic fluid flows past the check valve 43 from the check-valve cavity $42_1$ through the piston supply port 41 and into the high-pressure conduit 28. Then, the pressurized hydraulic fluid flows through the high-pressure conduit 28 into the actuation piston bore 64. The pressurized hydraulic fluid completely fills the actuation piston cavity 65, thus eliminating the valve train lash (except the predetermined valve lash δ), such as actuation piston lash, i.e., lash between the actuation piston 62 and the single-valve actuation pin 76. The increase in the volume of the hydraulic fluid in the actuation piston cavity 65 also allows the exhaust rocker roller follower 21 to maintain contact with the exhaust camshaft brake lift profile 7 and with the added displacement created by the actuation piston 62, eliminates the brake lift and provides a normal exhaust valve profile for the exhaust stroke marked in FIG. 12 as an exhaust valve lift profile 85, i.e., a brake-off valve lift.

In the engine brake-off mode, with the valve train lash eliminated (except the predetermined valve lash δ), the exhaust rocker arm 22 then proceeds from the lower base circle 5 on the exhaust cam 2 to the engine brake lift profile 7. When the engine brake lift profile 7 acts on the driven end 22*b* of the exhaust rocker arm 22 and pivotally rotates the exhaust rocker arm 22, and a distal end of the actuation piston 62 presses on the single-valve actuation pin 76, in turn pressing on an exhaust valve stem of the exhaust valve $\mathbf{3}_1$ only. Subsequently, the actuation piston 62 is forced to move upwardly so as to reduce the volume of the actuation piston cavity 65 without opening the exhaust valve $\mathbf{3}_1$. This results in increased pressure in the actuation piston cavity 65 created by a force of an exhaust valve spring $\mathbf{9}_1$ (shown in FIG. 19), inertia forces and cylinder pressure. This upward travel (movement) of the actuation piston 62 causes the displacement of the hydraulic fluid from the actuation piston cavity 65 back into the continuous supply conduit 26 through the open check valve 43. The volume of the hydraulic fluid below the actuation piston cavity 65 flows through the continuous supply conduit 26 back to the accumulator cavity 94 in the rocker shaft 20. Moreover, due to the predetermined valve lash δ, the adjusting screw 68 does not press onto the exhaust valve bridge 24. Thus, the exhaust valves $\mathbf{3}_1$ and $\mathbf{3}_2$ remain closed throughout the compression stroke during the positive power operation of the engine.

During the exhaust stroke of the positive power operation, when the exhaust cam profile 6 acts on the driven end 22*b* of the exhaust rocker arm 22 and pivotally rotates the exhaust rocker arm 22, the single-valve actuation pin 76 presses on the actuation piston 62. Subsequently, the actuation piston 62 is forced to move upwardly so as to reduce the volume of the actuation piston cavity 65. This results in increased pressure in the actuation piston cavity 65 created by the force of the exhaust valve spring $\mathbf{9}_1$ (shown in FIG. 19) of the exhaust valve $\mathbf{3}_1$, inertia forces and cylinder pressure. Again, the upward travel (movement) of the actuation piston 62 causes the displacement of the hydraulic fluid from the actuation piston cavity 65 back into the continuous supply conduit 26 through the open check valve 43. The volume of the hydraulic fluid below the actuation piston cavity 65 flows through the continuous supply conduit 26 back to the accumulator cavity 94. Then, when the predetermined valve lash δ is taken up and the rocker arm adjusting screw 68 presses on the exhaust valve bridge 24, the exhaust valve bridge 24 presses on and opens the exhaust valves $\mathbf{3}_1$ and $\mathbf{3}_2$ as during the conventional engine exhaust stroke illustrated as the exhaust valve lift profile 85 in FIG. 12. Specifically, when the rocker arm adjusting screw 68 presses on the exhaust valve bridge 24, the exhaust valve bridge 24 presses on the second exhaust valve $\mathbf{3}_2$ directly on a bridge surface 76*c* of the single-valve actuation pin 76, which, in turn, presses and opens the first exhaust valve $\mathbf{3}_1$.

When the engine brake is not activated (brake-off mode) and the exhaust cam is on the lower base circle 5, the actuation piston 62 extends in the actuation piston bore 64 in the exhaust rocker arm 22 to remove all valve train lash (except the predetermined valve lash δ). The engine brake profile 7 of the exhaust cam 2 cannot open the exhaust valve $\mathbf{3}_1$ for compression release braking since the reset check valve 43 is held open by the upset pin 58. The hydraulic fluid flows out of the actuation piston cavity 65 and into the rocker shaft accumulator 77 located in the rocker shaft 20 (as shown in FIGS. 11A and 11B). This added hydraulic fluid removes all of the valve train clearance in the valve train assembly. The removal of this clearance by the hydraulic fluid eliminates valve train noise and possible valve train damage.

During the brake-on mode, the solenoid valve 98 is energized, allowing the brake-on pressurized hydraulic fluid to be supplied to the brake-on supply conduit 30. The pressurized hydraulic fluid from the brake-on supply conduit 30 enters the reset cavity $\mathbf{42}_2$ in the cartridge body 34 of the exhaust valve reset device 32. The pressurized hydraulic fluid in the reset cavity $\mathbf{42}_2$ overcomes the biasing force of the trigger return spring 56 and moves the reset trigger 50 to the extended position. In this position, as best shown in FIGS. 5A and 9A, the elongated distal end 52 of the reset trigger 50 engages the exhaust valve bridge 24. Moreover, in the extended position of the reset trigger 50 (shown in FIGS. 5A and 9A), the ball-valve member 44 is returned to a closed position and is held on the check-ball seat 45 by the biasing force of the ball-check spring 46 so as to close the communication port 48 in the cartridge body 34, and to fluidly disconnect the continuous supply port 37 and the piston supply port 41 of the cartridge body 34. Now the pressurized hydraulic fluid fills the actuation piston cavity 65 and removes all of the exhaust valve train clearance by entering the check-valve cavity $\mathbf{42}_1$ through the continuous supply conduit 26 and the high-pressure conduit 28 and through the reset check valve 43 by overcoming the biasing force of the ball-check spring 46 when the hydraulic pressure in the continuous supply conduit 26 is higher than the hydraulic pressure in the actuation piston cavity 65. However, if the hydraulic pressure in the continuous supply conduit 26 is lower than the hydraulic pressure in the actuation piston cavity 65, the hydraulic fluid is checked in the high pressure hydraulic circuit and the engine brake cam profile and engine brake cycle is activated.

The engine braking operation is described hereafter.

The rocker shaft 20 that supplies the pressurized hydraulic fluid is designed with two passageways 97 and 99 to supply the pressurized hydraulic fluid to the continuous supply conduit 26 and the brake-on supply conduit 30, respectively, of the engine brake rocker arm assembly 16. The brake-on supply conduit 30 is controlled by the solenoid valve 98 that supplies the pressurized hydraulic fluid to the brake-on supply conduit 30, which displaces the reset trigger 50 downwardly allowing the reset check valve 43 to seat (i.e., in the closed position) and functions as a check valve to lock the hydraulic fluid in the high-pressure conduit 28 and the actuation piston cavity 65. The hydraulic pressure within the actuation piston cavity 65 assures that all lash is removed (including the actuation piston lash) from the valve train assembly (except the predetermined valve lash δ) and the exhaust rocker roller follower 21 of the exhaust rocker arm 22 is kept in contact with the exhaust cam 2.

To start the engine brake-on mode, the solenoid valve 98 is energized to flow oil through the brake-on oil supply conduit 30 to the reset cavity $\mathbf{42}_2$ to bias the reset trigger 50 downward and provide a clearance between the ball-valve member 44 and the upset pin 58 allowing the ball-check spring 46 to bias the ball-valve member 44 against the check-ball seat 45. The pressurized engine oil is supplied to the rocker arm continuous supply port 37 through the reset check valve 43 and the high-pressure conduit 28 and into the actuation piston cavity 65, removing all valve train lash between the single-valve actuation pin 76 and the actuation piston 62, and the cam follower 21 and the lobe of the exhaust cam 2.

With all valve train lash eliminated (except the predetermined valve lash δ) and the hydraulic fluid locked in the actuation piston cavity 65, the roller follower 21 proceeds from the lower base circle 5 on the exhaust cam 2 to the engine brake lift profile 7 to open only the exhaust valve $\mathbf{3}_1$ through the single-valve actuation pin 76 just prior to a Top Dead Center (TDC) in the compression stroke to evacuate the highly compressed air in the cylinder resulting from the compression stroke. When the engine brake lift profile 7 acts on the driven end 22*b* of the exhaust rocker arm 22 and pivotally rotates the exhaust rocker arm 22, a distal end of the actuation piston 62 presses on the single-valve actuation pin 76, in turn pressing on an exhaust valve stem of the first exhaust valve $\mathbf{3}_1$ only. When the actuation piston 62 presses the single-valve actuation pin 76 to open the first exhaust valve $\mathbf{3}_1$ just prior to TDC of the compression stroke during the compression-release engine braking event of the engine compression brake operation, the fluid pressure in the actuating piston cavity 65 becomes higher than the fluid pressure in the check-valve cavity $\mathbf{42}_1$, thus forcing the ball-valve member 44 of the check valve 43 to be seated on the check-ball seat 45, thus hydraulically locking the engine oil (hydraulic fluid) in the actuating piston cavity 65.

Figure 12:
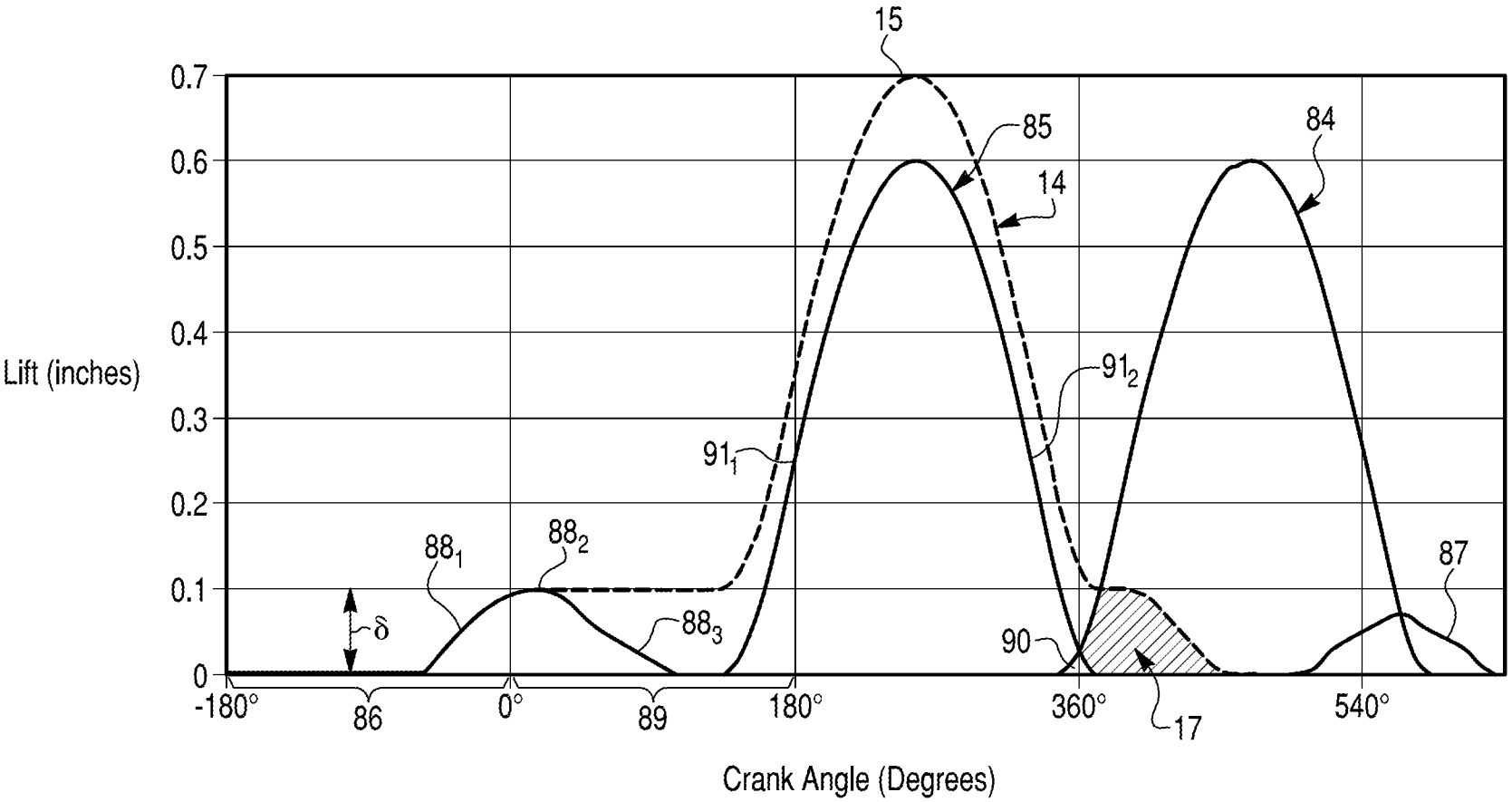
FIG. 12 is a graph illustrating inlet and exhaust valve lift vs. crank angle under a positive power operation and during an engine brake operation of the rocker arm compression-release engine brake system according to the exemplary embodiment of the present invention.

With all the valve train lash (except the predetermined valve lash δ) removed and hydraulically locked, the brake lift profile 7 of the exhaust cam member 2 opens only the first exhaust valve $\mathbf{3}_1$ just prior to TDC of the compression stroke during the compression-release engine braking event, as illustrated by a portion $\mathbf{88}_1$ of the exhaust valve lift profile 85 in FIG. 12. Due to the predetermined valve lash δ, the adjusting screw 68 does not press against the exhaust valve bridge 24. Thus, the second exhaust valve $\mathbf{3}_2$ remains closed throughout the compression-release engine braking event of the engine compression brake operation.

During the opening of the single exhaust valve $\mathbf{3}_1$ with the single-valve actuation pin 76, the cylinder pressure is increasing and rapidly reaches peak cylinder pressure just prior to TDC compression, then cylinder pressure drops rapidly just after TDC compression. Because of the compression release near TDC and the engine piston in the cylinder moving downward in the engine cylinder, the cylinder pressure is decreasing rapidly and so does the pressure in the actuation piston cavity 65, resulting in lower pressure biasing the ball-valve member 44 against the check-ball seat 45.

During the compression-release engine braking event during the power stroke, a process of resetting the exhaust valve $\mathbf{3}_1$ is accomplished by the elongated distal end 52 of the reset trigger 50 coming in contact with a top surface 24*a* of the exhaust valve bridge 24, which acts as a preset stop member as the exhaust valve bridge 24 is not movable relative to the rocker shaft 20 during the compression-release braking operation due to the predetermined valve lash δ.

Upon the contact of the elongated distal end 52 of the reset trigger 50 with the exhaust valve bridge 24, as the driving end 22*a* of the exhaust rocker arm 22 rotates downward by the action of the brake lift profile 7 of the exhaust cam member 2, the reset trigger 50, which is biased downward by the fluid pressure of the brake-on supply conduit 30, is forced upward relative to the cartridge body 34 toward the reset check valve 43 (against the biasing force of the pressurized hydraulic fluid in the reset cavity $\mathbf{42}_2$) by the exhaust valve bridge 24. As a result, the reset pressure spring 57 is compressed and the upset pin 58 contacts the ball-valve member 44 in the seated position. The reset pressure spring 57 in the compressed state creates an upward force on the ball-valve member 44 and the hydraulic pressure in the actuation piston cavity 65 biases the ball-valve member 44 into the seated position. When the biasing force of the reset pressure spring 57 exceeds the force created by the decreasing pressure in the actuation piston cavity 65, the ball-valve member 44 is forced off its seat 45, thereby unseating the ball-valve member 44 of the check valve 43 (i.e., moving the ball-valve member 44 to the open position) against the biasing force of the ball-check spring 46 by the upset pin 58.

In other words, reset occurs when the reset trigger 50 is forced upward by rotation of the exhaust rocker arm 22 causing the reset pressure spring 57 to be compressed and apply a high force to the ball-valve member 44 of the check valve 43 that is initially not capable of moving the ball off its seat 45 until cylinder pressure and pressure in the actuation piston cavity 65 is reduced to the point that the reset pressure spring 57 will force the ball-valve member 44 off its seat 45. This occurs at the end of the expansion stroke 89 when cylinder pressure is low.

Opening of the check valve 43 results in releasing a portion of the hydraulic fluid from the actuation piston cavity 65, i.e., allowing the pressurized hydraulic fluid in the actuation piston cavity 65 to return to the continuous supply conduit 26 in the exhaust rocker arm 22. This causes the actuation piston 62 and the single-valve actuation pin 76 to move upward, thus permitting the single exhaust valve $\mathbf{3}_1$ to be reset and return the first exhaust valve $\mathbf{3}_1$ back to its valve seat.

During engine brake operation of the engine without the exhaust valve reset device 32, with all valve train lash removed (except the predetermined valve lash δ), a normal exhaust valve lift profile 14 will be increased in a lift 15 and duration, as shown in FIG. 12. The increased exhaust valve lift 15 requires increased piston/valve clearance to eliminate possible exhaust valve and engine piston contact at a top dead center (TDC) exhaust/intake without the valve reset device. With the valve lash δ removed, the exhaust valve increased lift 15 will extend the intake and exhaust valve overlap 17 at TDC, as shown in FIG. 12. The extended valve overlap 17 allows flow of the high pressure exhaust gas in the exhaust manifold back into the engine cylinder and then into the air intake manifold. This can result in inlet noise, damage to inlet air components and reduced engine braking retarding power. For the reasons above, an exhaust valve reset device is desirable on an engine brake rocker arm lost motion system. Portion 87 of the exhaust valve lift profile 14 illustrates an optimal pre-charging event caused by the action of the pre-charge lift profile 8 of the exhaust cam member 2 (shown in FIG. 12). A normal intake valve lift profile 84 is also shown in FIG. 12.

During engine brake operation of the engine with the exhaust valve reset device 32 (shown at 88 in FIG. 12), the reset trigger 50 is positioned to start releasing the hydraulic oil located in the actuating piston cavity 65 back into the high-pressure conduit 28 and the rocker shaft accumulator 77 at approximately 50% of the compression-release engine braking event (shown at $\mathbf{88}_2$ in FIG. 12). As a result, the first exhaust valve $\mathbf{3}_1$ is closed, thus resetting the first exhaust valve $\mathbf{3}_1$ back to the closed position, illustrated by a portion $\mathbf{88}_3$ of an exhaust valve braking lift profile 88 in FIG. 12. This will resume a normal positive power exhaust valve lift profile (85 in FIG. 12) eliminating the extended exhaust valve lift and extended overlap at TDC, as illustrated at 90 in FIG. 12. Now both the exhaust valves $\mathbf{3}_1$ and $\mathbf{3}_2$ will be opened by the exhaust cam profile 6 and by the rocker arm adjusting screw 68 contacting the exhaust bridge 24.

As illustrated in FIG. 12, the exhaust/intake valve overlap 90 at TDC during the operation of the compression-release engine brake system 12 with the exhaust valve reset device 32 is substantially smaller than the intake and exhaust valve overlap 17 during the operation of the compression-release engine brake system without the exhaust valve reset device 32 according to the present invention. In other words, because the pressurized hydraulic fluid is released from the actuating piston cavity 65, the exhaust valves $\mathbf{3}_1$ and $\mathbf{3}_2$ will resume the normal positive power exhaust valve lift profile 85, eliminating the extended exhaust valve lift (15 in FIG. 12) and the extended overlap (17 in FIG. 12). Therefore, resetting the exhaust valves $\mathbf{3}_1$ and $\mathbf{3}_2$ back to the closed positions (i.e., releasing the pressurized hydraulic fluid from the actuating piston cavity 65 during the compression-release engine braking event) eliminates extended intake/exhaust valve overlap that results in reduced exhaust manifold back pressure and reduced engine brake retarding power.

Make-up hydraulic fluid to refurbish the reset hydraulic fluid is supplied from the rocker shaft accumulator 77 that, according to the exemplary embodiment of the present invention, is located in the rocker arm shaft 20. Alternatively, the rocker shaft accumulator 77 can be located in the rocker arm shaft support. This accumulated hydraulic fluid will be stored in the rocker shaft accumulator 77 at close proximity and at a higher pressure to assist in completely filling the actuating piston cavity 65 and the high-pressure conduit 28 for the next pre-charge lift profile 8 or the engine brake exhaust lift profile 7. The pre-charge lift profile 8 of the exhaust cam lobe 2 opens the first exhaust valve $\mathbf{3}_1$ near the end of the intake stroke. This adds a high pressure air charge and additional boost from the exhaust manifold into the cylinder at the start of the exhaust stroke to enable more work to be done on the air during the compression stroke and potentially on the exhaust stroke and, depending on high exhaust manifold backpressure, could produce a reduced engine brake exhaust sound level.

Therefore, the lost motion rocker arm compression-release engine brake system according to the first exemplary embodiment of the present invention opens only one of two exhaust valves during the engine compression release event and resets the one exhaust valve prior to the normal exhaust stroke valve motion. In the first exemplary embodiment of the present invention, the engine compression release single exhaust valve lift opening is approximately 0.100 inches and the lift starts just prior to TDC compression stroke.

Contemporary diesel engines are usually equipped with an exhaust valve bridge and two exhaust valves. A reset device according to the present invention is desirable to close the single braking exhaust valve prior to the opening of both exhaust valves during the normal exhaust stroke, so that the exhaust valve bridge is not in an unbalanced condition. An unbalanced condition is where the single-valve actuation pin has not returned the single braking exhaust valve to the seated position resulting in an unbalanced force on the bridge during normal exhaust valve opening.

The reset device 32, according to the first exemplary embodiment of the present invention, is located further away from a center of rotation of the exhaust rocker arm 22 (or the rocker arm shaft 20) than a center of the exhaust valve bridge 24 and the adjusting screw 68 to provide the maximum trigger motion to allow the reset trigger 50 to move upward in the cartridge body 34 removing lash between the ball-valve member 44 and the upset pin 58, and to provide compression of the reset pressure spring 57. Compression release cylinder pressure results in biasing the reset check valve 43 closed, by the high hydraulic circuit pressure. During the beginning of the expansion stroke, the cylinder pressure decreases rapidly to a value that the reset pressure spring 57 that is being compressed can lift the ball-valve member 44 off the seat 45 thereof.

At the time when the ball-valve member 44 is forced off its seat 45, the hydraulic fluid in the actuation piston cavity 65 will be released, thereby resetting the single engine brake exhaust valve $\mathbf{3}_1$. The resetting function occurs prior to the normal exhaust stroke, resulting in both exhaust valves $\mathbf{3}_1$ and $\mathbf{3}_2$ being seated and the exhaust valve bridge 24 can now be opened by the exhaust rocker arm 22 with the exhaust bridge 24 in a balanced condition.

Present lost motion rocker brakes are commercially available without resetting and are accomplished by incorporating increased strength bridge guide pins to solve the unbalanced bridge loading problem. The prior art approach is more costly and provides less retarding performance because of the extended intake/exhaust valve overlap condition. Extended intake/exhaust valve overlap results in the loss of exhaust manifold air mass and pressure back into the cylinder and inlet manifold. The loss of exhaust manifold pressure decreases engine brake retarding performance.

The single valve rocker arm lost motion compression-release engine brake system with reset, according to the present invention, reduces cost of a conventional engine brake system or even a dedicated cam brake. The rocker arm compression-release engine brake system of the present invention provides better performance than an exhaust cam driven brake or even an injector driven one. The performance of the single valve rocker arm compression-release engine brake system of the present invention compared to a dedicated cam engine brake in most circumstances will be close. Compared to other engine brake configurations, the single valve rocker arm lost motion compression-release engine brake system with reset is better in weight, cost of development, requirements to make fundamental changes to existing engines, engine height and manufacturing cost per engine.

FIGS. 13-15B illustrate a second exemplary embodiment of a valve train assembly of internal combustion engine, generally depicted by the reference character 110. Components, which are unchanged from the first exemplary embodiment of the present invention, are labeled with the same reference characters. Components, which function in the same way as in the first exemplary embodiment of the present invention depicted in FIGS. 1-12 are designated by the same reference numerals to some of which 100 has been added, sometimes without being described in detail since similarities between the corresponding parts in the two embodiments will be readily perceived by the reader.

The valve train assembly 110 includes a rocker arm compression-release engine brake system 112 according to the second exemplary embodiment of the present invention, provided for an internal combustion (IC) engine. Preferably, the IC engine is a four-stroke diesel engine.

Figure 13:
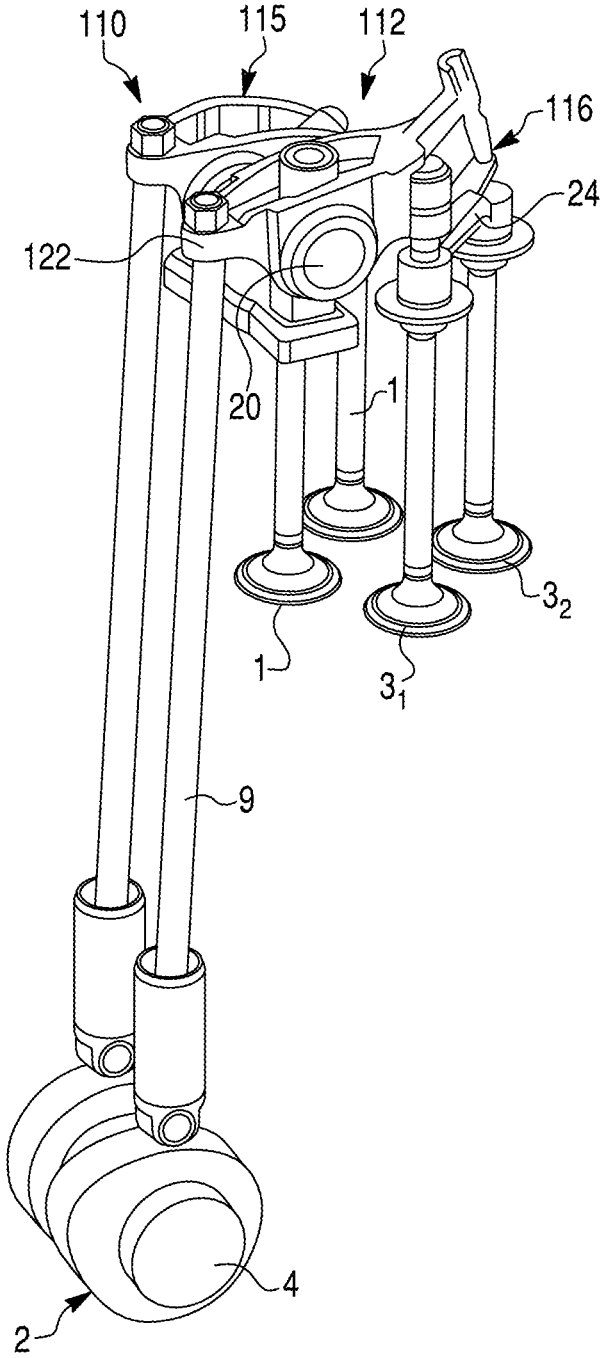
FIG. 13 is a perspective view of a valve train assembly including a rocker arm compression-release engine brake system according to a second exemplary embodiment of the present invention.

As illustrated in FIG. 13, the rocker arm compression-release engine brake system 112 according to the second exemplary embodiment of the present invention includes a conventional intake rocker assembly 115 for operating two intake valves 1, and a lost motion exhaust rocker assembly 116 for operating the exhaust valve(s). The compression-release brake system 112 in accordance with the second exemplary embodiment of the present invention includes a pushrod 9 actuating the exhaust rocker assembly 116 and driven by the exhaust cam 2, as shown in FIG. 13.

The exhaust rocker assembly 116 according to the second exemplary embodiment of the present invention is a lost motion type provided with automatic hydraulic adjusting and resetting functions. The exhaust rocker assembly 116 includes an exhaust rocker arm 122 pivotally mounted about a rocker shaft 20 and provided to open first and second exhaust valves $\mathbf{3}_1$ and $\mathbf{3}_2$, respectively, through an exhaust valve bridge 24. The rocker shaft 20 is supported by rocker arm supports (or rocker arm pedestals) 25 and extends through a rocker arm bore 133 formed in the exhaust rocker arm 122 (shown in FIGS. 13-15B).

Figure 14:
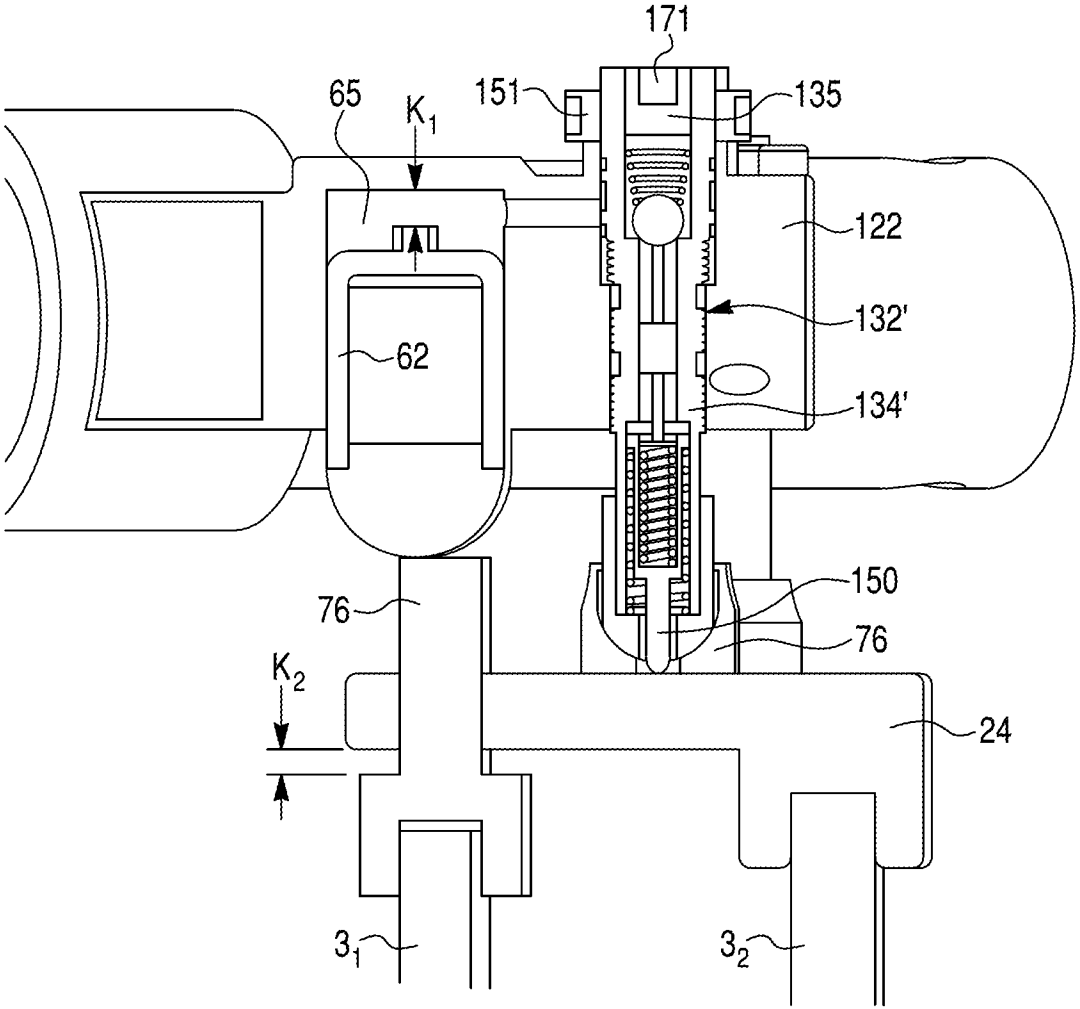
FIG. 14 is a sectional view of the rocker arm compression-release engine brake system according to the second exemplary embodiment of the present invention in a brake-on mode.

The rocker arm compression-release brake system 112 further comprises an exhaust valve reset device 132 disposed in the exhaust rocker arm 122. The exhaust valve reset device 132 according to the second exemplary embodiment of the present invention is substantially structurally and functionally identical to the exhaust valve reset device 32 of the first exemplary embodiment of the present invention (shown in detail FIGS. 8-9B) and is in the form of a substantially cylindrical cartridge and comprises a substantially cylindrical cartridge body 134 provided with an annular supply groove 136 fluidly connected with the continuous supply conduit 26, an annular brake-on groove 38 fluidly connected with the brake-on supply conduit 30, and an annular piston groove 140 fluidly connected with the high-pressure conduit 28. The cylindrical cartridge body 134 is threadedly and adjustably disposed within a substantially cylindrical reset bore in the exhaust rocker arm 122. Moreover, the cartridge body 134 is provided with a contacting foot 72 swivelably mounted to a distal end of the cartridge body 134 adjacent to the exhaust valve bridge 24. As shown in FIGS. 14 and 15B, the reset trigger 150 extends from the cartridge body 134 and the contacting foot 72 through an opening in the contacting foot 72.

As best illustrated in FIG. 14, each of the supply groove 136, the brake-on groove 138 and the piston groove 140 are formed on an outer peripheral cylindrical surface of the cartridge body 134 and axially spaced from each other. The cylindrical cartridge body 134 is disposed within a substantially cylindrical reset bore in the exhaust rocker arm 122 so as to set a predetermined valve lash (or clearance) δ between the contacting foot 72 and the exhaust valve bridge 24 when the exhaust rocker roller follower is in contact with a lower base circle 5 on the exhaust cam 2, i.e., when the exhaust cam 2 is not acting (pressing) on the exhaust rocker arm 122. The predetermined valve lash δ (such as 0.05") is set to provide a normal exhaust valve motion in a positive power operation with clearance for valve train components growth at engine operating temperatures. During engine brake operation all lash (except the predetermined valve lash δ) is removed from the valve train and the brake cam profile determines the opening timing, profile and lift of the exhaust valve.

Figure 15A:
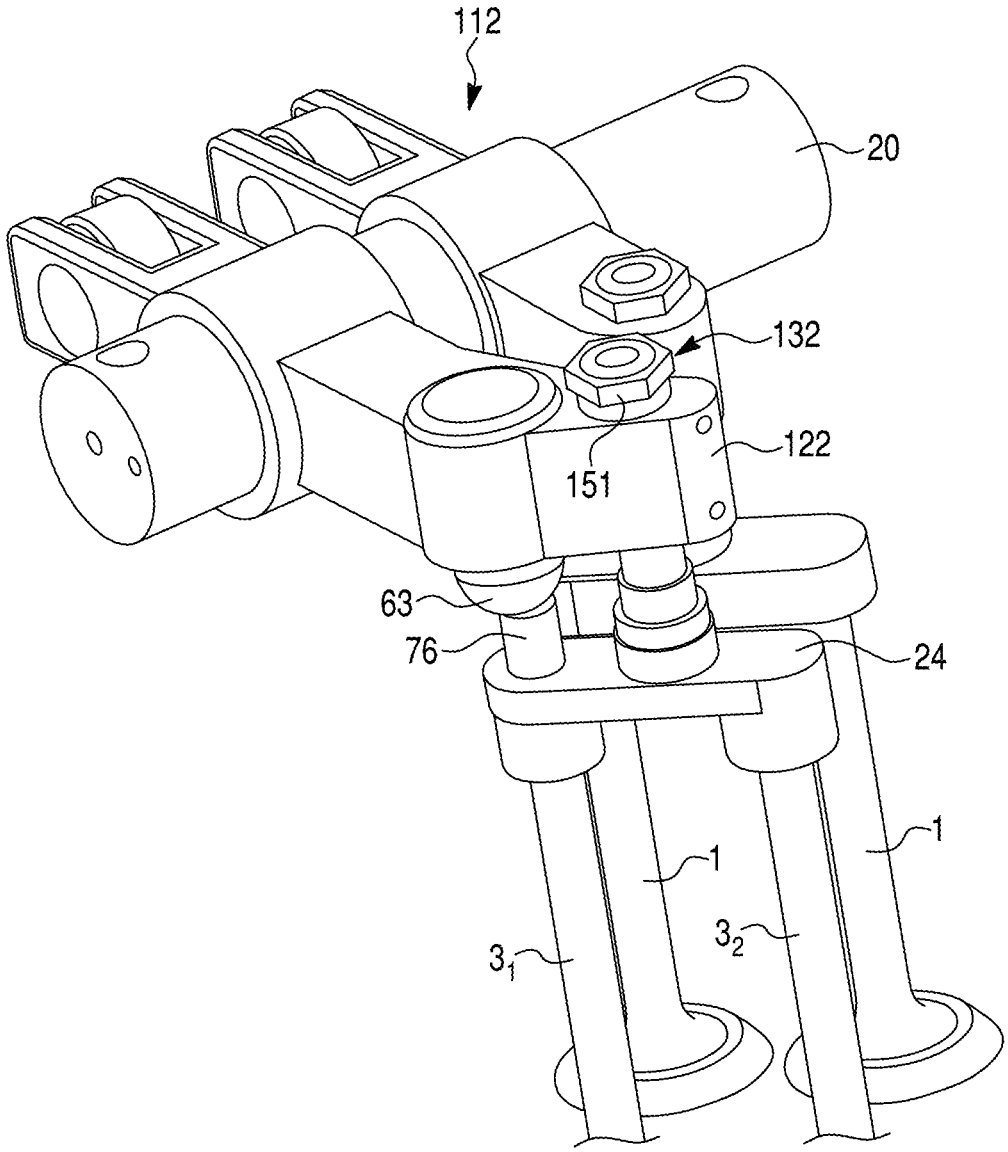
FIG. 15A is an alternative perspective view of the valve train assembly including the rocker arm compression-release engine brake system according to the second exemplary embodiment of the present invention.
Figure 15B:
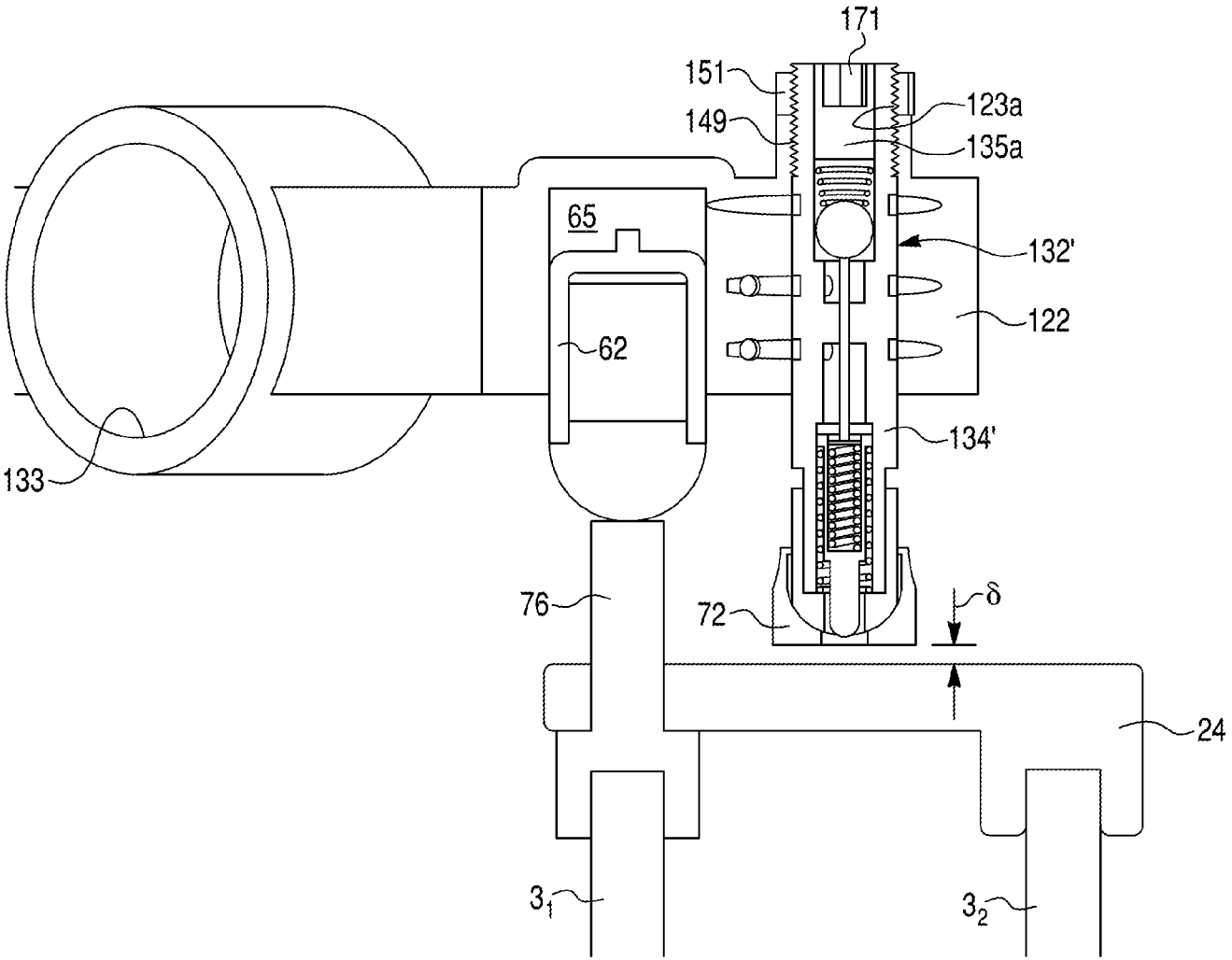
FIG. 15B is a sectional view of the rocker arm compression-release engine brake system of FIG. 15A in a brake-off mode.

Alternatively, an outer peripheral cylindrical surface 149 of a cartridge body 134' of an alternative embodiment of an exhaust valve reset device, generally depicted with the reference numeral 132', is wholly or at least partially threaded as best illustrated in FIGS. 15A and 15B. Each of the supply groove 136, the brake-on groove 138 and the piston groove 140 are formed on the threaded outer peripheral cylindrical surface 149 of the cartridge body 134' and axially spaced from each other. The threaded cylindrical cartridge body 134' is adjustably disposed within a substantially cylindrical, threaded reset bore 123*a* in the exhaust rocker arm 122 for setting a predetermined valve lash (or clearance) δ between the contacting foot 72 and the exhaust valve bridge 24 when the exhaust rocker roller follower is in contact with a lower base circle 5 on the exhaust cam 2, i.e., when the exhaust cam 2 is not acting (pressing) on the exhaust rocker arm 122.

An upper cartridge plug 135*a* is non-movably secured (i.e., fixed) to the cartridge body 134' and is provided with a hexagonal socket 171 accessible from above the exhaust rocker arm 122 for setting the predetermined valve lash δ. A lock nut 151 is provided on the adjusting threaded cylindrical cartridge body 134'. The predetermined valve lash δ is set to provide normal exhaust valve motion in a positive power operation with clearance for valve train component growth at engine operating temperatures. During engine brake operation all lash (except the predetermined valve lash δ) is removed from the valve train and the brake cam profile determines the opening timing, profile and lift of the exhaust valve. In other words, the reset device 132 combines the functions of a rocker arm adjusting screw assembly and a check valve and reset device. Such an arrangement of the exhaust valve reset device is especially beneficial for an internal combustion engine with an overhead camshaft.

FIGS. 16-18B illustrate a third exemplary embodiment of a valve train assembly of an internal combustion (IC) engine, generally depicted by the reference character 310. Components, which are unchanged from the first exemplary embodiment of the present invention, are labeled with the same reference characters. Components, which function in the same way as in the first exemplary embodiment of the present invention depicted in FIGS. 1-12 are designated by the same reference numerals to some of which 300 has been added, sometimes without being described in detail since similarities between the corresponding parts in the two embodiments will be readily perceived by the reader.

The valve train assembly 310 includes a rocker arm compression-release engine brake system 312. Preferably, the IC engine is a four-stroke diesel engine, comprising a cylinder block including a plurality of cylinders. The rocker arm compression-release engine brake system 312 includes a conventional intake rocker assembly (not shown) for operating two intake valves 1, and a lost motion exhaust rocker assembly 316 for operating first and second exhaust valves $\mathbf{3}_1$ and $\mathbf{3}_2$. The exhaust rocker assembly 316 according to the third exemplary embodiment of the present invention is of a lost motion type provided with automatic hydraulic adjusting and resetting functions. The exhaust rocker assembly 316 includes an exhaust rocker arm 322 pivotally mounted about a rocker shaft 20 and provided to open the first and second exhaust valves $\mathbf{3}_1$ and $\mathbf{3}_2$, respectively, through an exhaust valve bridge 24. The rocker shaft 20 is supported by rocker arm supports (or rocker arm pedestals) and extends through a rocker arm bore 333 formed in the exhaust rocker arm 322 (shown in FIG. 16).

Figure 18A:
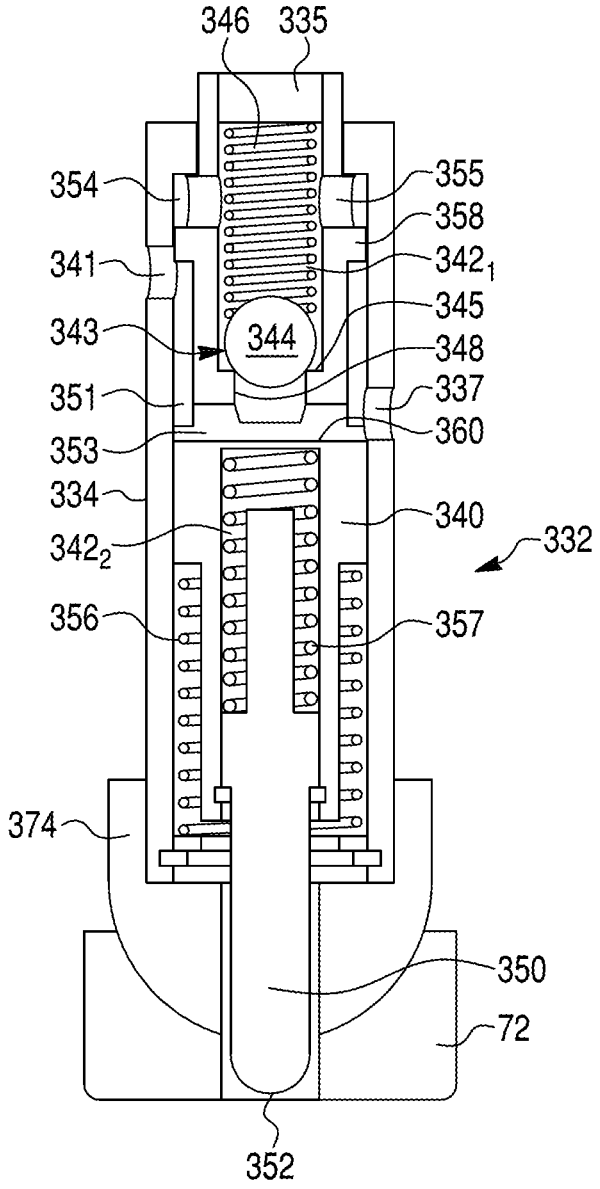
FIG. 18A is a sectional view of an exhaust valve reset device according to the third exemplary embodiment of the present invention in the brake-off mode.
Figure 18B:
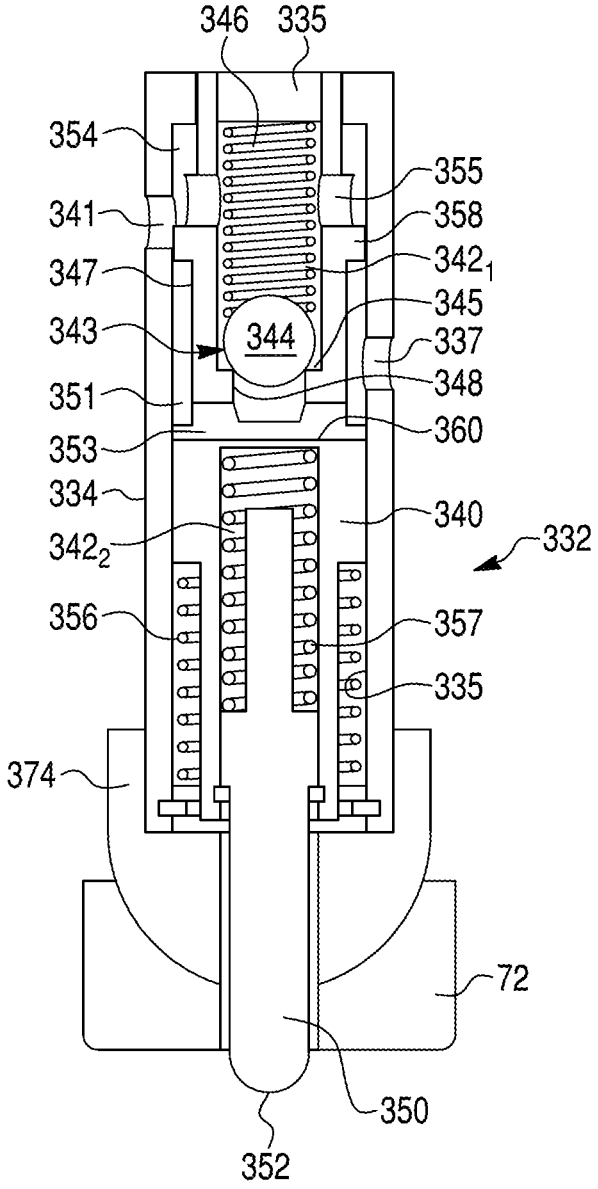
FIG. 18B is a sectional view of the exhaust valve reset device according to the third exemplary embodiment of the present invention in the brake-on mode.

The rocker arm compression-release brake system 312 further comprises an exhaust valve reset device 332 disposed in the exhaust rocker arm 322 in the direction substantially parallel to the exhaust valves $\mathbf{3}_1$ and $\mathbf{3}_2$. The exhaust valve reset device (or spool cartridge) 332 according to the third exemplary embodiment of the present invention, as best illustrated in FIGS. 18A and 18B, is in the form of a compression release spool cartridge assembly and comprises a substantially cylindrical cartridge body 334 provided with a continuous hydraulic fluid pressure supply port 337 fluidly connected with the continuous hydraulic fluid pressure supply conduit 26 and a piston supply port 341 fluidly connected with an actuation piston cavity 65 through the high-pressure conduit 28. The continuous pressure supply port 337 and the piston supply port 341 are axially spaced from each other. The cylindrical cartridge body 334 is non-movably disposed within a substantially cylindrical reset bore in the exhaust rocker arm 322. In the third exemplary embodiment of the present invention, the cylindrical cartridge body 334 is threadedly and adjustably disposed within the substantially cylindrical reset bore in the exhaust rocker arm 322, i.e., the reset device 332 is adjustable for the predetermined exhaust valve lash δ. Moreover, the cartridge body 334 is provided with a contacting (or elephant) foot 372 swivelably mounted to a sliding ball foot 374, in turn mounted to a distal end of the cartridge body 334 adjacent to the exhaust valve bridge 24. In other words, the reset device 332 according to the third exemplary embodiment of the present invention combines functions of a rocker arm adjusting screw assembly and an exhaust valve reset device.

The reset device 332 further comprises a substantially cylindrical reset spool 340 axially slidingly disposed within the cylindrical cartridge body 334. The reset spool 340 is movable within and relative to the cartridge body 334 between a refracted position shown in FIGS. 17A and 18A, and an extended position shown in FIGS. 17B and 18B.

As further illustrated in FIGS. 18A and 18B, the reset spool 340 has an inner cavity therewithin, which is divided by a separating wall 360 into a check-valve cavity $\mathbf{342}_1$ and a reset cavity $\mathbf{342}_2$. The check-valve cavity $\mathbf{342}_1$ within the reset spool 340 is enclosed between an upper cartridge plug 335 and the separating wall 360. The reset spool 340 is further formed with a first annular spool recess 350 between an inner peripheral surface 335 of the cartridge body 334 and an outer peripheral surface 347 of the reset spool 340. The first annular recess 351 defines a lower spool cavity and is in a constant direct fluid communication with the continuous pressure supply port 337 in the cartridge body 334. In turn, the lower spool cavity 351 is in fluid communication with the check-valve cavity $\mathbf{342}_1$ through at least one first communication port 353 in the reset spool 340. The lower spool cavity 351 is selectively fluidly connected to the piston supply port 341 depending on an axial position of the reset spool 340. For, example, in the retracted position of the reset spool 340, shown in FIG. 18A, the lower spool cavity 351 is fluidly connected to the piston supply port 341, while in the extended position of the reset spool 340, shown in FIG. 18B, the lower spool cavity 351 is fluidly disconnected from the piston supply port 341.

The reset spool 340 is further formed with a second annular spool recess 354 between the inner peripheral surface 335 of the cartridge body 334 and the outer peripheral surface 347 of the reset spool 340. The second annular recess 354 defines an upper spool cavity and is in fluid communication with the check-valve cavity $\mathbf{342}_1$ through at least one second communication port 355 in the reset spool 340. As best illustrated in FIGS. 18A and 18B, the lower spool cavity 351 is fluidly separated from the upper spool cavity 354 by an annular flange 358, which is in sliding contact with the inner peripheral surface 335 of the cartridge body 334. In other words, the at least one second communication port 355 is axially spaced from the at least one first communication port 353. The second communication port 355 is provided to selectively fluidly connect the check-valve cavity $\mathbf{342}_1$ with the piston supply port 341 depending on an axial position of the reset spool 340.

The reset device 332 further comprises a ball-valve member 344, and a ball-check spring 346 disposed between the ball-valve member 344 and the upper cartridge plug 335. The ball-valve member 344 is held on a check-ball seat 345 by a biasing spring force of the ball-check spring 346 so as to close a communication port 348 in the reset spool 340, which fluidly connects the continuous pressure supply port 337 of the cartridge body 334 and the check-valve cavity $\mathbf{342}_1$ of the reset spool 340. The ball-valve member 344, the check-ball seat 345 and the ball-check spring 346 define a reset check valve 343. The check valve 343 provides selective fluid communication between the continuous supply conduit 26 and the high-pressure conduit 28 (i.e., between the continuous supply conduit 26 and the actuation piston cavity 65) through the second communication ports 355. It will be appreciated that any appropriate type of the check valve is within the scope of the present invention.

The continuous pressure supply port 337 and the piston supply port 341 are formed on an outer peripheral cylindrical surface of the cartridge body 334 and axially spaced from each other. The threaded cylindrical cartridge body 334 is adjustably disposed within the substantially cylindrical reset bore in the exhaust rocker arm 322.

The exhaust valve reset device 332 further comprises a reset trigger 350 axially slidable within the reset cavity $\mathbf{342}_2$ of the reset spool 340. The reset trigger 350 has a semi-spherical distal end 352 at least partially extending from the cartridge body 334. The reset trigger 350 is movable relative to the cartridge body 334 between a retracted position shown in FIGS. 17A and 18A, and an extended position shown in FIGS. 17B and 18B. The reset spool 340 is normally biased to the retracted position by a trigger return spring 356 disposed within the cartridge body 334 and outside the reset spool 340. The reset trigger 350 is also normally biased to an extended position within the reset spool 340 by a reset pressure spring 357 disposed within the cartridge body 334 and inside the reset cavity $\mathbf{342}_2$ of the reset spool 340. The reset trigger 350 is provided to lift the reset spool 340 through the resilient biasing action of the reset pressure spring 357 to reset brake operation.

Figure 17A:
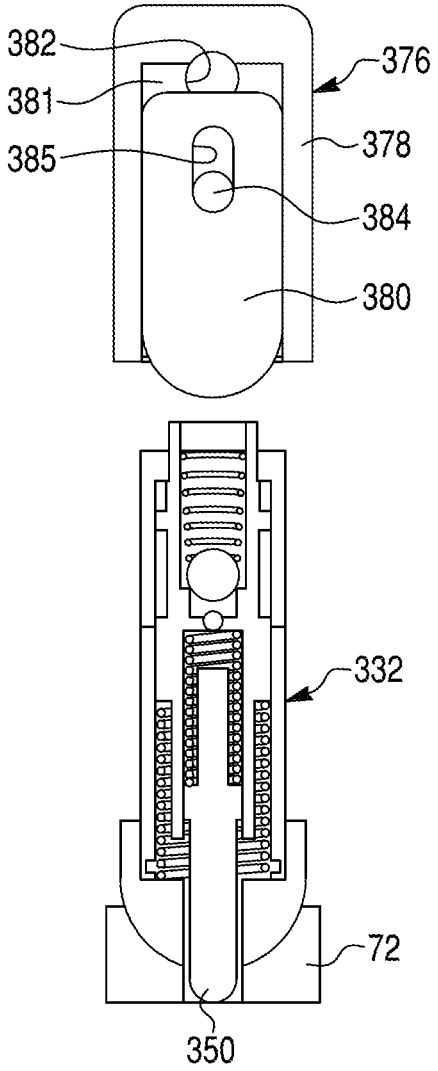
FIG. 17A is a sectional view of the rocker arm compression-release engine brake system according to the third exemplary embodiment of the present invention in the brake-off mode.
Figure 17B:
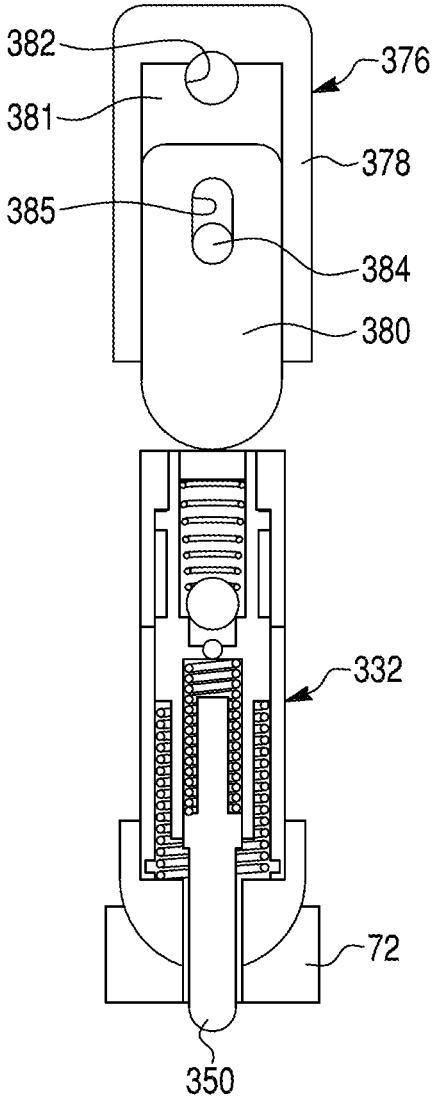
FIG. 17B is a sectional view of the rocker arm compression-release engine brake system according to the third exemplary embodiment of the present invention in the brake-on mode.

The valve train assembly 310 according to the third exemplary embodiment of the present invention further comprises a compression release actuator 376 provided to selectively move the reset spool 340 between the retracted position shown in FIGS. 17A and 18A, and the extended position shown in FIGS. 17B and 18B. The compression release actuator 376, shown in FIGS. 17A and 17B, is in the form of a fluid (such as pneumatic or hydraulic) actuator. Alternatively, the compression release actuator 376 may be in the form of a solenoid actuator. The fluid compression release actuator 376 comprises a casing 378 non-movable relative to the rocker shaft 20, and a brake-on piston 380 reciprocating within the casing 378. The brake-on piston 380 defines an actuation (or brake-on) piston cavity 381 within the casing 378 (best shown in FIGS. 17A and 17B). The casing 378 includes a fluid port 382 open to the actuation piston cavity 381 and connected with a source of pressurized fluid (air or liquid), such as a brake-on supply conduit. The casing 378 is provided with a piston stroke limiting pin 384 that limits upward and downward linear movement of the brake-on piston 380. Specifically, the brake-on piston 380 is provided with an axially extending groove 385 receiving the piston stroke limiting pin 384 therein.

The compression-release brake system 312 operates in a compression brake mode, or brake-on mode (during the engine compression brake operation) and a compression brake deactivation mode, or brake-off mode (during the positive power operation).

Figure 16:
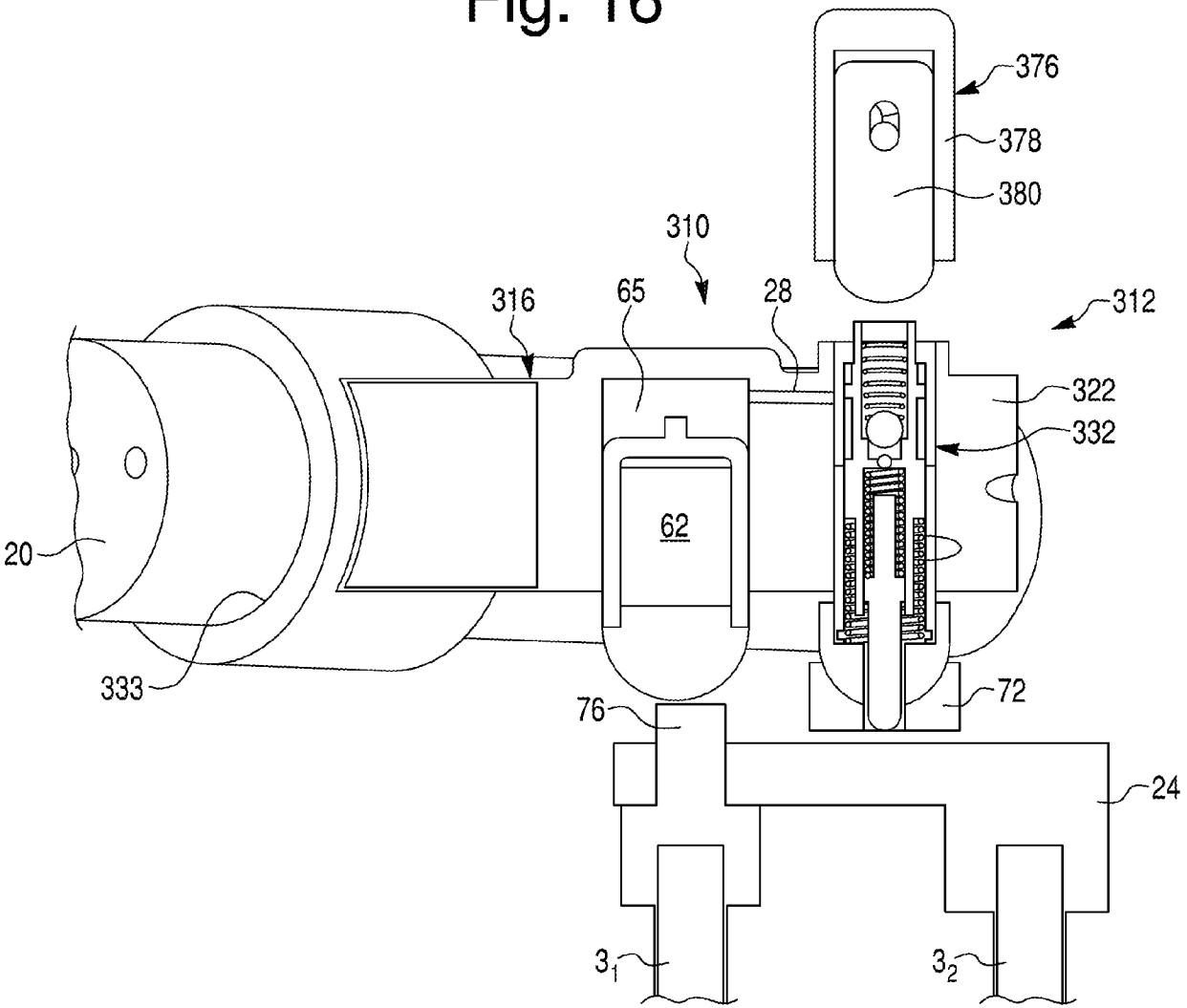
FIG. 16 is a sectional view of a valve train assembly including a rocker arm compression-release engine brake system according to a third exemplary embodiment of the present invention in the brake-off mode.

In operation of the engine with the rocker arm compression-release engine brake system 312 with the reset device 332 according to the third exemplary embodiment of the present invention, during the brake-off mode the compression release actuator 376 is deactivated and the brake-on piston 380 is in a retracted position so that the brake-on piston 380 is axially spaced from the reset spool 340 of the reset device 332, as illustrated in FIGS. 16 and 17A. Consequently, the reset spool 340 is biased to the retracted position by the trigger return spring 356, best shown in FIG. 18A. In this position, the reset trigger 350 does not extend from the elephant foot 372. In the brake-off mode, the pressurized hydraulic fluid, such as engine oil, is continuously supplied to the continuous pressure supply port 337 and provides engine oil to flow back and forth through the lower spool cavity 351 to the piston supply port 341. This continuing oil flow removes the mechanical clearance in a valve train (except the predetermined valve lash δ) during the positive power engine operation to eliminate valve train clatter and to maintain continuous contact between the exhaust cam profile and roller follower.

Accordingly, during the brake-off mode, the pressurized fluid is continuously supplied from the continuous supply conduit 26 to the actuation piston cavity 65 through the lower spool cavity 351 and the piston supply port 341 of the reset device 332, and the high-pressure passageway 28, as shown in FIGS. 16, 17A and 18A.

The engine braking operation during the brake-on mode is as follows.

To activate the engine brake, the compression release actuator 376 is activated and the brake-on piston 380 moves into an extended position, shown in FIG. 17B. Subsequently, the brake-on piston 380 forces the reset spool 340 down, sealing off the piston supply port 341 from the lower spool cavity 351. The actuation piston cavity 65 continues to be filled with the pressurized hydraulic fluid from the continuous pressure supply port 337 through the check valve 343, the check-valve cavity $\mathbf{342}_1$, the at least one second communication port 355 in the reset spool 340, the upper spool cavity 354, and the piston supply port 341. At the same time, the check valve 343 hydraulically locks the actuation piston cavity 65 when the brake-on actuation piston 62 is fully extended downward. The exhaust rocker arm 322 when positioned on lower base circle 5 of the exhaust cam 2 will start to open the single exhaust valve $\mathbf{3}_1$, releasing compressed air from the engine cylinder. At approximately 0.050 inch exhaust valve lift, the semi-spherical distal end 352 of the reset trigger 350 contacts the exhaust bridge 24 resulting in the reset pressure spring 357 producing an increasing biasing force on the reset spool 340 to move upward.

During the engine compression stroke the biasing forces of the brake-on piston 380 of the compression release actuator 376 and hydraulic pressure in the upper spool cavity 354 bias the reset spool 340 in the extended position thereof. On the other hand, the reset pressure spring 357 and the trigger return spring 356 bias the reset spool 340 in the retracted position. As the cylinder pressure continues to increase, the hydraulic pressure in the upper spool cavity 354 also increases, creating a larger biasing force to maintain the reset spool 340 in the downward, extended position and continuing to lock the hydraulic fluid in the actuation piston cavity 65 above the single valve actuation piston 62.

When the engine stroke changes from the compression stroke to the expansion stroke, the cylinder pressure decreases rapidly to approximately atmospheric pressure. When the pressure in the piston supply port 341 and the upper spool cavity 354 decreases to approximately 250 psi pressure, any significant hydraulic biasing force on the reset spool 340 is eliminated, resulting in the upward biasing force of the reset pressure spring 357 exceeding the downward biasing force of the compression release actuator 376. As a result, the reset spool 340 transitions upward to open the piston supply port 341 to the lower spool cavity 351, thus unlocking the actuation piston 62, i.e., allowing the hydraulic fluid from the actuation piston cavity 65 to flow back into the continuous oil supply conduit 126 through the continuous pressure supply port 337. This oil flow through the continuous pressure supply port 337 allows the single exhaust valve $\mathbf{3}_1$ to be reseated and completes single valve reset function. The reset pressure spring 357 has a spring rate such as to generate an adequate force to be able to overcome the force of approximately 100 pounds from the valve spring $\mathbf{9}_1$ of the braking exhaust valve $\mathbf{3}_1$ hat creates the pressure differential across the reset ball-valve member 444 of the reset check valve 443 at the end of the expansion stroke to reset the single exhaust valve $\mathbf{3}_1$.

Figure 19:
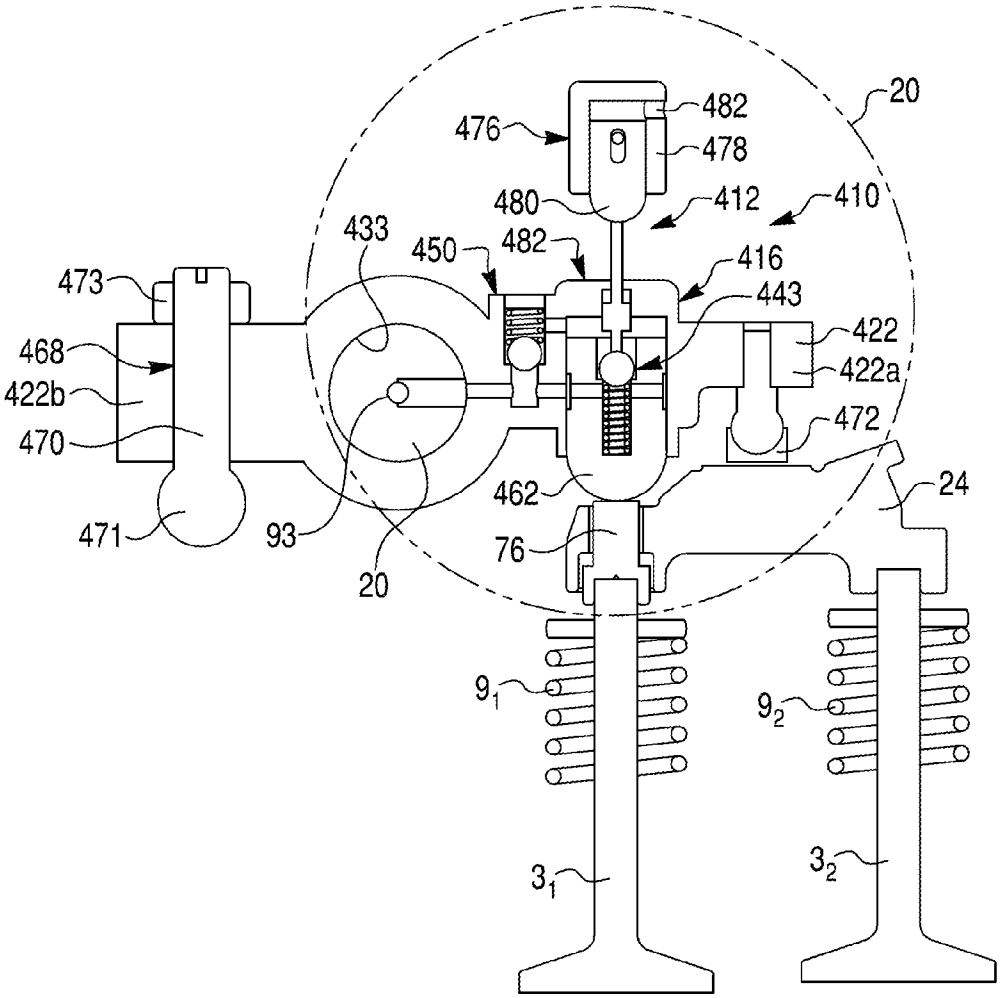
FIG. 19 is a sectional view of a valve train assembly including a rocker arm compression-release engine brake system according to a fourth exemplary embodiment of the present invention in the brake-on mode.
Figure 20:
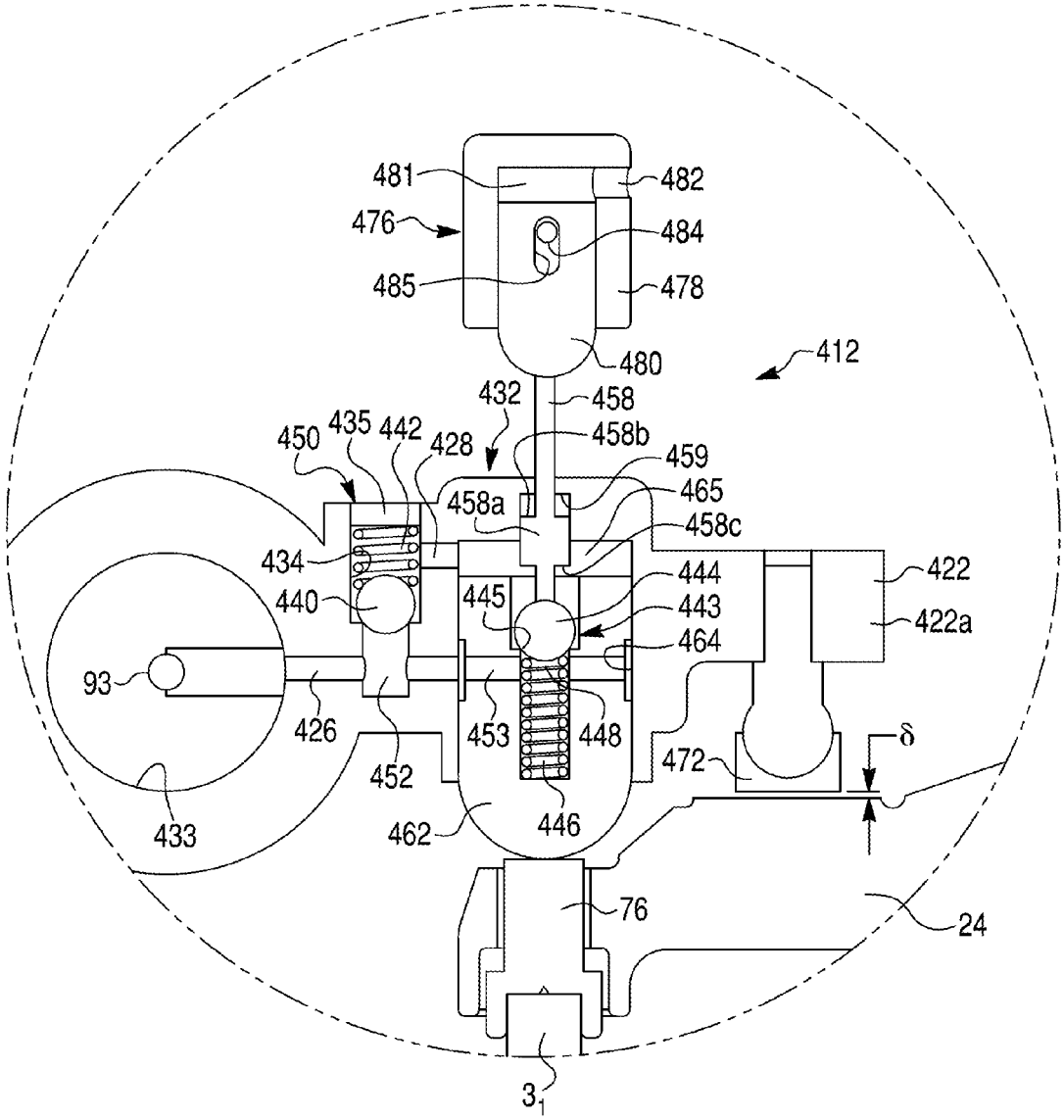
FIG. 20 is an enlarged front view of a fragment of the compression-release engine brake system shown in the circle 20 of FIG. 19.

FIGS. 19 and 20 illustrate a fourth exemplary embodiment of a valve train assembly of an internal combustion (IC) engine, generally depicted by the reference character 410. Components, which are unchanged from the first exemplary embodiment of the present invention, are labeled with the same reference characters. Components, which function in the same way as in the first exemplary embodiment of the present invention depicted in FIGS. 16-18B are designated by the same reference numerals to some of which 100 has been added, sometimes without being described in detail since similarities between the corresponding parts in the two embodiments will be readily perceived by the reader.

The valve train assembly 410 includes a rocker arm compression-release engine brake system 412. Preferably, the IC engine is a four-stroke diesel engine, comprising a cylinder block including a plurality of cylinders. The rocker arm compression-release engine brake system 412 comprises a conventional intake rocker assembly (not shown) for operating two intake valves 1, and a lost motion exhaust rocker assembly 416 for operating first (or braking) and second exhaust valves $\mathbf{3}_1$ and $\mathbf{3}_2$, respectively. The exhaust rocker assembly 416 according to the fourth exemplary embodiment of the present invention is a lost motion type provided with automatic hydraulic adjusting and resetting functions. The exhaust rocker assembly 416 includes an exhaust rocker arm 422 pivotally mounted about a rocker shaft 20 and provided to open the first and second exhaust valves $\mathbf{3}_1$ and $\mathbf{3}_2$, respectively, through an exhaust valve bridge 24. The rocker shaft 20 is supported by rocker arm supports (or rocker arm pedestals) and extends through a rocker arm bore 433 formed in the exhaust rocker arm 422 (shown in FIG. 19).

The IC engine incorporating the compression-release brake system 412 in accordance with the fourth exemplary embodiment of the present invention includes a pushrod (shown in FIG. 13) actuating the exhaust rocker assembly 416 and driven by the exhaust cam 2 (shown in FIG. 13). The exhaust rocker arm 422 has a driving (first distal) end 422*a* provided to operatively engage the engine exhaust valves $\mathbf{3}_1$ and $\mathbf{3}_2$ for controlling the engine exhaust valves $\mathbf{3}_1$ and $\mathbf{3}_2$, and a driven (second distal) end 22*b* located adjacent to the pushrod.

The rocker arm brake system 412 also comprises a substantially cylindrical actuation piston bore 464 formed in the exhaust rocker arm 422 for slidably receiving an actuation piston 462 (best shown in FIG. 20) therein. The actuation piston 462 is moveable between retracted and extended positions relative to the reset piston bore 464 in a direction substantially parallel to the exhaust valves $\mathbf{3}_1$ and $\mathbf{3}_2$, and is configured to contact a top end surface 76*a* of a single-valve actuation pin 76 (best shown in FIG. 20). The single-valve actuation pin 76 is slidably movable relative to the exhaust valve bridge 24. The actuation piston 462 defines a reset piston cavity 465 within the reset piston bore 464 in the exhaust rocker arm 422 (best shown in FIG. 20). The exhaust single-valve actuation pin 76 allows the actuation piston 462 to press against the first exhaust valve $3_1$ to open the first exhaust valve $3_1$ (only one of the two exhaust valves) during the compression-release engine braking operation (i.e., in the brake-on mode). In other words, the single-valve actuation pin 76 is reciprocatingly movable relative to the exhaust valve bridge 24 so as to make the first exhaust valve $3_1$ movable relative to the second exhaust valve $3_2$ and the exhaust valve bridge 24.

The rocker arm brake system 412 further comprises an exhaust valve reset device 432 disposed in the exhaust rocker arm 422. The exhaust valve reset device 432 includes a reset check valve disposed in the actuation piston 462, as shown in FIGS. 19 and 20. In the exemplary embodiments of the present invention, the reset check valve is in the form of a ball-check valve 443, which is normally biased open. It will be appreciated that any appropriate type of the check valve, other than the ball-check valve, is also within the scope of the present invention. The reset check valve 443 includes a ball-valve member 444, a check-ball seat 445 and a biasing (or reset) spring 446 that biases the reset ball-valve member 444 upward to an open position of the reset check valve 443.

The ball-valve member 444 is biased open, i.e., held away from the check-ball seat 445 by a biasing spring force of the reset spring 446, so as to open a communication port 448 in the actuation piston 462, which fluidly connects the reset piston cavity 465 with a communication conduit 453 formed through the actuation piston 462. In turn, the communication conduit 453 in the actuation piston 462 is fluidly connected directly to the continuous supply conduit 426. In other words, when the reset check valve 443 is open, the continuous supply conduit 426 is fluidly connected to the reset piston cavity 465.

The exhaust valve reset device 432 of the rocker arm brake system 412 further includes a rocker check valve 450 also disposed in the exhaust rocker arm 422. In the exemplary embodiment of the present invention, the rocker check valve 450 is in the form of a ball-check valve, which is normally biased closed. It will be appreciated that any appropriate type of the check valve, other than the ball-check valve, is also within the scope of the present invention. The rocker check valve 450 is disposed in a check-valve bore 434 formed in the exhaust rocker arm 422 substantially perpendicular to the rocker arm bore 433 receiving the rocker shaft 20. The bore 434 is closed by a plug 435. The rocker check valve 450 comprises a ball-valve member 440 disposed in the check-valve bore 434, and a ball-check spring 442 biasing the all-valve member 440 to closing position thereof. In other words, the ball-valve member 440 is held on a check-ball seat by a biasing spring force of the ball check spring 442 so as to close a communication opening 452 through the rocker check valve 450, which fluidly connects the continuous supply conduit 426 and the reset piston cavity 465 through a reset conduit 428.

The rocker arm brake system 412 according to the fourth exemplary embodiment of the present invention further comprises a compression release actuator 476 provided to selectively control the exhaust valve reset device 432. The compression release actuator 476, shown in FIGS. 19 and 20, is in the form of a fluid (such as pneumatic or hydraulic) actuator. Alternatively, the compression release actuator 476 may be in the form of a solenoid actuator. The fluid compression release actuator 476 comprises a casing 478 non-movable relative to the rocker shaft 20, and a brake-on piston 480 reciprocating within the casing 478. The brake-on piston 480 defines a brake-on piston cavity 481 within the casing 478 (best shown in FIG. 20). The casing 478 includes a brake-on fluid supply port 482 open to the brake-on piston cavity 481 and connected with a source of pressurized fluid (air or liquid). The casing 478 is provided with a piston stroke limiting pin 484. The piston stroke limiting pin 484 is an adjustable positive stop that limits upward and downward linear movement of the brake-on piston 480. Specifically, the brake-on piston 480 is provided with an axially extending groove 485 receiving the piston stroke limiting pin 484 therein.

The rocker arm brake system 412 according to the fourth exemplary embodiment of the present invention further comprises a reset pin 458 extending between the brake-on piston 480 and the reset ball-valve member 444 of the reset check valve 443.

Moreover, the exhaust rocker arm 422 includes a rocker arm adjusting screw assembly 468 (as best shown in FIG. 1) adjustably mounted in the driven end 422*b* of the exhaust rocker arm 422 so that the adjusting screw assembly 468 is disposed in the exhaust valve drive train on a camshaft side of the engine, and is operatively coupled to the pushrod. The adjusting screw assembly 468 defines an adjustable linkage placed in the exhaust valve drive train between the exhaust rocker arm 422 and the pushrod.

As best illustrated in FIG. 19, the rocker arm adjusting screw assembly 468 is provided to engage the pushrod in order to open the exhaust valves $3_1$ and $3_2$. The adjusting screw assembly 468 includes an adjustment screw 470 adjustably, such as threadedly, mounted in the driven end 422*b* of the exhaust rocker arm 422.

The screw assembly 468 comprises an adjustment screw 470 having a ball-like end 471 for being received in a socket (not shown) coupled to a top end of the pushrod. The adjustment screw 470 is adjustably, such as threadedly, mounted in the driven end 422*b* of the exhaust rocker arm 422 and fastened in place by a locknut 473.

The compression-release brake system 412 operates in a compression brake mode, or brake-on mode (during the engine compression brake operation) and a compression brake deactivation mode, or brake-off mode (during the positive power operation).

The engine braking operation during the brake-on mode is as follows.

To activate the engine brake, the compression release actuator 476 is activated and the pressurized fluid enters the brake-on piston cavity 481 through the brake-on fluid supply port 482. Pneumatic or hydraulic fluid, such as engine oil, supplied to the brake-on piston cavity 481, forces the brake-on piston 480 downward. Subsequently, the brake-on piston 480 moves into an extended position thereof so as to engage and move downward the piston stroke limiting pin 484, shown in FIG. 19. The brake-on fluid supply port 482 is regulated to maintain a constant supply pressure to maintain a continuous force of approximately 16 pounds biasing the brake-on piston 480 downward to close the ball-valve member 444. Alternatively, the brake-on piston 480 of the compression release actuator 476 may be activated by an electronic solenoid or an electric magnet. The downward linear movement of the brake-on piston 480 biases the reset pin 458 downward and closes the reset check valve 443. As the reset check valve 443 is closed by the brake-on piston 480 via the reset pin 458, the actuation piston 462 does not retract into the reset piston bore 464 because the hydraulic fluid is locked within the reset piston bore 464 by the closed reset check valve 443 and the rocker check valve 450.

The operation of the compression-release engine brake system 412 according to the fourth exemplary embodiment requires opening only one of the two exhaust valves $\mathbf{3}_1$ and $\mathbf{3}_2$ so not to exceed the valve train maximum valve train loading specifications. The opening of the braking exhaust valve $\mathbf{3}_1$ incorporates a single valve brake lift of approximately 0.100 inches. The compression-release engine brake system 412 requires the brake-on piston 480 to provide a substantial downward biasing force to the ball-valve member 444 of the reset check valve 443 via the reset pin 458 to seal (i.e., close) the reset check valve 443 for approximately 50% of the typical 0.100 inch lift of the braking exhaust valve $\mathbf{3}_1$ for the initial valve opening. In other words, the ball-valve member 444 is biased closed mechanically in the first 0.050 inches of the single valve brake lift.

When the lift of the braking exhaust valve $\mathbf{3}_1$ is at approximately 50% (or 0.050 inches) of its entire engine brake braking lift, the brake-on piston 480 engages the adjustable piston stroke limiting pin (or positive stop) 484. From that moment on the downward linear movement of the brake-on piston 480 is prevented. Subsequently, as the exhaust rocker arm 422 continues to move the exhaust bridge 24 downward, the brake-on piston 480 stops pushing the reset pin 458 downward.

Cylinder pressure and, therefore, the valve force against the actuation piston 462 continues to rise during the second half of the motion of the braking exhaust valve $\mathbf{3}_1$. The increasing hydraulic pressure now holds the reset ball-valve member 444 firmly on its seat 445, such that contact with the reset pin 458 is no longer needed for the last (or second) 50% of motion. In other words, the downward biasing force of the reset pin 458 on the ball-valve member 444 is eliminated at approximately 50% of the opening of the braking exhaust valve $\mathbf{3}_1$ resulting from the contact of the brake-on piston 480 with the adjustable positive stop 484, as the exhaust rocker arm 422 continues to open the braking exhaust valve $\mathbf{3}_1$. Cylinder pressure continues to increasing during the compression stroke, thus biasing the braking exhaust valve $\mathbf{3}_1$ upward and increasing the pressure of the oil in the reset piston cavity 465. As a result, the downward biasing force acting to the reset ball-valve member 444 is provided. The high pressure in the reset piston cavity 465 produces a high pressure differential across the reset ball-valve member 444 to continue to bias the reset ball-valve member 444 seated, i.e., to the closed position of the reset check valve 443. In other words, the pressure in the actuation piston cavity 465 hydraulically biases the reset check valve 443 closed for the second and final half (i.e., 0.050 inch lift) of the single valve brake lift.

As described above, internal to the actuation piston 462 is the reset spring 446 that biases the reset ball-valve member 444 upward to an open position of the reset check valve 443 with an approximate initial force of the reset spring 446 of 13 pounds of force. During the expansion stroke 89 the cylinder pressure $\mathbf{89}_P$ will decrease rapidly resulting from the air released from the cylinder during the engine brake's compression relief event near TDC compression stroke.

The cylinder air mass, which is released through the opening of the braking exhaust valve $\mathbf{3}_1$ into the engine's exhaust manifold, results in a very low cylinder pressure near the end of the expansion stroke. Since the braking exhaust valve $\mathbf{3}_1$ remains open at approximately 0.100 inches lift, a valve spring $\mathbf{9}_1$ of the braking exhaust valve $\mathbf{3}_1$ creates an upward biasing force of approximately 100 pound-force (lbf) to the actuation piston 462.

Towards the end of the expansion stroke 89 when the cylinder pressure is close to atmospheric and an added small biasing force from the valve spring $\mathbf{9}_1$ of the braking exhaust valve $\mathbf{3}_1$, the higher biasing force from the reset spring 446 lifts the reset ball-valve member 444 off the seat 445 thereof resulting in returning of the hydraulic fluid from the reset piston cavity 465 back to the continuous supply conduit 426 and the hydraulic fluid supply passage 93, such as engine oil supply. The returning hydraulic fluid flow allows the valve spring $\mathbf{9}_1$ of the braking exhaust valve $\mathbf{3}_1$ to force the actuation piston 462 upward to initiate contact between the reset pin 458 and the brake-on piston 480.

The resilient biasing force of the valve spring $\mathbf{9}_1$ of the braking exhaust valve $\mathbf{3}_1$ is approximately 100 pound-force (lbf) creating approximately 220 psi pressure in the reset piston cavity 465 to force the hydraulic fluid back into the hydraulic fluid supply passage 93 allowing the actuation piston 462 to travel upward. When the braking exhaust valve $\mathbf{3}_1$ approaches 0.050 inches from the seated position, the reset pin 458 contacts the brake-on piston 480 and then reset ball-valve member 444 will be seated, i.e., the reset check valve 443 is closed.

The biasing force of the valve spring $\mathbf{9}_1$ of the braking exhaust valve $\mathbf{3}_1$, which is approximately 100 lbf, exceeds the approximately 12 pound downward biasing force of the brake-on piston 480 forcing the brake-on piston 480 upward and positioned to approximately 0.050 inches above the adjustable positive stop 484. This causes the actuation piston 462 and the single-valve actuation pin 76 to move upward, thus permitting the single exhaust valve $\mathbf{3}_1$ to be reset and return the first exhaust valve $\mathbf{3}_1$ back to its valve seat. In other words, resetting the single exhaust braking valve $\mathbf{3}_1$ is achieved by sensing the decreasing cylinder pressure and corresponding hydraulic pressure in the actuation piston cavity 465 during the expansion stroke to unseat the check ball 444 and release hydraulic fluid from the actuation piston cavity 465 to close or reset the single exhaust valve $\mathbf{3}_1$ to eliminate unbalanced exhaust bridge prior to the normal exhaust valve lift.

The hydraulic fluid supply passage 93 can add the final required make-up oil to the reset piston cavity 465 through the rocker check valve 450.

The rocker check valve 450 is fluidly connected to the continuous supply conduit 426 for supplying the hydraulic fluid to the reset piston cavity 465. The rocker check valve 450 is required to completely fill the reset piston cavity 465 prior the start of the compression braking stroke. The operation of the brake-on piston 480 biases the reset check valve 443 seated for approximately 0.050 inches of the lift of the braking exhaust valve $\mathbf{3}_1$ both during opening $\mathbf{91}_1$ and closing $\mathbf{91}_2$ exhaust lift profiles.

During refilling of the actuation piston cavity 465 the passageway 453 adds supply oil only until the brake-on piston 480 and the reset pin 458 bias the reset ball-valve member 444 of the reset check valve 443 prior to the last 0.050" of the single valve brake lift (or lost motion) to be taken up. Because the reset ball-valve member 444 is designed to seal the reset check valve 443 for the first 0.050" of the single braking lift it cannot add make-up reset supply oil during the last the last 0.050" of the single braking lift. For this reason, the rocker check valve 450 is required.

The reset check valve 443 is biased closed by the brake-on piston 480 (through the reset pin 458) for the initial 0.050 inch of an opening portion $\mathbf{88}_1$ of an exhaust cam profile lift 88 during the compression-release engine braking event, thereby preventing the continuous supply conduit 426 to add any make-up oil at normal oil supply pressure. The conical biasing spring 442 of the rocker check valve 450 has a low biasing force providing the make-up oil from the continuous supply conduit 426 to completely fill the reset piston cavity 465 and remove all exhaust valve train clearance prior to the next compression-release engine braking event 88 (shown in FIG. 12).

During the expansion stroke 89, the hydraulic fluid from the reset piston cavity 465 flows back into the continuous supply conduit 426 permitting the seating (displacement) of the braking exhaust valve $\mathbf{3}_1$ to its closed position. With the braking exhaust valve $\mathbf{3}_1$ seated (or closed), the normal exhaust cycle commences operation with both the exhaust valves $\mathbf{3}_1$ and $\mathbf{3}_2$ closed, which eliminates the unbalanced exhaust valve bridge 24 opening consisting of the closed outer exhaust valve $\mathbf{3}_2$ and the partially opened braking exhaust valve $\mathbf{3}_1$.

During the engine compression operation, a peak cylinder pressure in the engine cylinder can be as high as 1000 psi resulting in a pressure of approximately 4000 psi in the reset piston cavity 465. The reset pin 458 comprises an enlarged, such as cylindrical, portion (or stop portion) 458*a* formed integrally (i.e. non-moveably or fixedly) therewith between distal ends of the reset pin 458 and disposed in the reset piston cavity 465. The stop portion 458*a* of the reset pin 458 is configured to control an upper stop of the reset pin 458 in the reset piston cavity 465 and to control the upper biasing force resulting from hydraulic pressure in the reset piston cavity 465. A cross-sectional area (or diameter) of the stop portion 458*a* is larger than a cross-sectional area (or diameter) of the reset pin 458 outside of the cylindrical portion 458*a*. The differential area of the reset pin 458 is designed to minimize an internal surface area of the reset pin 458 inside the reset piston cavity 465 to reduce or eliminate undesired biasing of the reset ball-valve member 444 during seating and unseating functions. Moreover, an upper pin stop surface 458*b* of the stop portion 458*a* faces and is configured to selectively engage a reset stop surface 459 of the exhaust rocker arm 422 to limit an upward movement of the reset pin 458.

The engine operation during the brake-off mode is as follows.

In operation of the engine with the rocker arm compression-release engine brake system 412 with the exhaust valve reset device 432 according to the fourth exemplary embodiment of the present invention, during the brake-off mode, the compression release actuator 476 is deactivated and the brake-on piston 480 is in a retracted position thereof. Consequently, the reset check valve 443 is biased open by the reset spring 446.

In this position, the reset pin 458 does not bias the reset check valve 443 closed. In the brake-off mode, the pressurized hydraulic fluid, such as engine oil, is continuously supplied to the reset piston cavity 465 from the continuous supply conduit 426 through the communication conduit 453, the communication port 448 and the open reset check valve 443. Moreover, the open reset check valve 443 allows the pressurized hydraulic fluid to flow into and out of the reset piston cavity 465 through the communication conduit 453 and the communication port 448 to the continuous supply conduit 426. This continuing oil flow removes the mechanical clearance in a valve train (except the predetermined valve lash δ, best shown in FIG. 20) during the positive power engine operation to eliminate valve train clatter and to maintain continuous contact between the exhaust cam profile and roller follower.

When the brake-on fluid supply to the brake-on piston cavity 481 through the brake-on fluid supply port 482 is off, the reset pin 458 is biased upward to the reset stop surface 459 of the exhaust rocker arm 422 by the reset spring 446 and by the hydraulic fluid pressure acting to a lower pin stop surface 458*c* of the stop portion 458*a*, thereby biasing the reset ball-valve member 444 upward to the open position thereof for allowing unrestricted fluid flow in the reset piston cavity 465 to flow engine oil from the continuous supply conduit 426 freely into and out of the reset piston cavity 465 to remove all exhaust valve train lash to reduce valve train impact and mechanical noise during positive power engine operation.

During the compression stroke 86, all valve train lash is removed by the addition of the pressurized hydraulic fluid to the reset piston cavity 465 through the continuous supply conduit 426 so that the reset piston 462 engages the braking exhaust valve $\mathbf{3}_1$. Near the end of the compression stroke 86, the engine brake lift profile 7 of the exhaust cam 2 rotates the exhaust rocker arm 422. As the exhaust rocker arm 422 moves pivotally toward the braking exhaust valve $\mathbf{3}_1$, the reset piston 462 is unable to overcome the resilient biasing force of the valve spring $\mathbf{9}_1$ of the braking exhaust valve $\mathbf{3}_1$ and is displaced into the reset piston bore 464 so that the pressurized hydraulic fluid flows from the reset piston cavity 465 through the open reset check valve 443, which is biased off its seat 445 by the reset spring 446, into the continuous supply conduit 426.

After completion of the exhaust lift profile 88 (shown in FIG. 12), the pressurized hydraulic fluid flows from the continuous supply conduit 426 through the open reset check valve 443, which is biased off its seat 445 by the reset spring 446, back into the reset piston cavity 465 to bias the reset piston 462 downward toward the braking exhaust valve $\mathbf{3}_1$ and removing the valve train lash.

Subsequently, the exhaust rocker arm 422 is on the exhaust cam profile (or upper base circle) 6 of the exhaust cam 2 ready to continue the normal exhaust cam lift profile 85. With the reset spring 446 continuously holding the reset ball-valve member 444 off its seat 445 thereby allowing unrestrictive flow of the engine oil in the reset piston cavity 465, the valve train lash is eliminated during the positive power operation of the engine.

Therefore, incorporating a hydraulic lash adjuster and an exhaust valve reset device on a lost motion rocker arm brake has the advantages of not having to adjust brake valve lash at initial installation and at service intervals and having an automatic valve train adjustment to accommodate any valve train wear and to reduce valve train mechanical sound levels. Moreover, the rocker arm compression-release engine brake system according to the present invention is lighter than conventional compression-release engine brake systems, provides lower valve cover height and reduced cost.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A compression-release brake system for operating at least one exhaust valve of an internal combustion engine, said compression-release brake system operating in a brake-on mode during a compression-release engine braking operation and a brake-off mode during a positive power operation, said compression-release brake system maintaining said at least one exhaust valve open during a portion of a compression stroke of the engine when performing the compression-release engine braking operation, said compression-release brake system comprising:

an exhaust rocker assembly for operating said at least one exhaust valve, said exhaust rocker assembly including an exhaust rocker arm mounted about a rocker shaft and selectively pivotable to open said at least one exhaust valve;

an actuation piston moveable between retracted and extended positions and slidably disposed in an actuation piston bore formed in said exhaust rocker arm, said actuation piston operatively coupled to said at least one exhaust valve when in the extended position thereof;

said actuation piston defining an actuation piston cavity within said actuation piston bore between said actuation piston bore and said actuation piston;

a supply conduit formed within said exhaust rocker arm, said supply conduit configured to supply pressurized hydraulic fluid to said actuation piston cavity to displace said actuation piston to the extended position when there is a gap between said actuation piston and said at least one exhaust valve; and an exhaust valve reset device mounted to said exhaust rocker arm and including a reset check valve disposed between said supply conduit and said actuation piston cavity to hydraulically lock said actuation piston cavity by closing said reset check valve when a pressure of the hydraulic fluid within said actuation piston cavity exceeds the pressure of the hydraulic fluid in said supply conduit;

said reset check valve biased closed by the pressure of the hydraulic fluid within said actuation piston cavity when operating in the brake-on mode during the compression stroke of the internal combustion engine;

said reset check valve biased open by the pressure of the hydraulic fluid within said actuation piston cavity when operating in the brake-on mode during an expansion stroke of the internal combustion engine.

2. The compression-release brake system according to claim 1, comprising an exhaust valve bridge and first and second exhaust valves such that said exhaust rocker arm is selectively pivotable to open both said first and second exhaust valves through said exhaust valve bridge.

3. The compression-release brake system according to claim 2, wherein said actuation piston engages only said first exhaust valve in the extended position of said actuation piston.

4. The compression-release brake system according to claim 3, wherein said exhaust valve bridge has an opening such that a single-valve actuation pin is slidably movable relative to said exhaust valve bridge through said opening therein so that said actuation piston engages said first exhaust valve through said actuation pin.

5. The compression-release brake system according to claim 3, wherein said reset check valve is normally biased closed by a biasing spring.

6. The compression-release brake system according to claim 5, wherein said reset device further comprises a cartridge body mounted to said exhaust rocker arm and defining an inner cavity therewithin which houses said reset check valve; and wherein said inner cavity is fluidly connected with said continuous supply conduit and a high-pressure conduit that fluidly connects said inner cavity of said reset device with said actuation piston cavity.

7. The compression-release brake system according to claim 6, wherein said cartridge body is adjustably disposed within said exhaust rocker arm.

8. The compression-release brake system according to claim 6, wherein said cartridge body includes a continuous supply port fluidly connected to said continuous supply conduit and a piston supply port fluidly connected to said high-pressure conduit.

9. The compression-release brake system according to claim 8, wherein said inner cavity is fluidly connected with a brake-on supply conduit.

10. The compression-release brake system according to claim 9, wherein said cartridge body further includes a brake-on supply port fluidly connected to said brake-on supply conduit.

11. The compression-release brake system according to claim 10, wherein said reset check valve is disposed between said supply conduit and said high-pressure conduit to selectively control fluid communication therebetween; and wherein said high-pressure conduit provided between said actuation piston cavity and said reset check valve.

12. The compression-release brake system according to claim 11, wherein said cartridge body of said reset device is non-moveable relative to said exhaust rocker arm during compression-release engine braking operation.

13. The compression-release brake system according to claim 12, wherein said reset device further comprises a reset trigger extending from said exhaust rocker arm; and wherein said reset trigger has an elongated distal end at least partially extending from said cartridge body toward said exhaust valve bridge and is movable relative to said cartridge body between an extended position and a retracted position.

14. The compression-release brake system according to claim 13, wherein said reset trigger is normally biased to the retracted position by a trigger return spring.

15. The compression-release brake system according to claim 14, wherein said exhaust valve reset device further comprises an upset pin extending between said reset trigger and said reset check valve for opening said reset check valve when said reset trigger is in the retracted position.

16. The compression-release brake system according to claim 15, wherein said cartridge body is provided with a contacting foot swivelably mounted to a distal end thereof adjacent to said exhaust valve bridge.

17. The compression-release brake system according to claim 16, wherein said reset trigger extends from said contacting foot through an opening therein.

18. The compression-release brake system according to claim 6, further comprising a compression release actuator operatively coupled to said reset device.

19. The compression-release brake system according to claim 18, wherein said compression release actuator comprises a casing non-movable relative to said rocker shaft and a brake-on piston reciprocating within said casing; wherein said brake-on piston defines a brake-on piston cavity within said casing; and wherein said casing includes a fluid port open to said brake-on piston cavity and connected with a source of pressurized fluid.

20. The compression-release brake system according to claim 19, wherein said casing is provided with a piston stroke limiting pin that limits upward and downward movement of said brake-on piston.

21. The compression-release brake system according to claim 20, wherein said brake-on piston has an axially extending groove receiving said piston stroke limiting pin therein.

22. The compression-release brake system according to claim 19, wherein said cartridge body of said reset device is moveable relative to said exhaust rocker arm during compression-release engine braking operation.

23. The compression-release brake system according to claim 4, further comprising a compression release actuator operatively coupled to said reset device.

24. The compression-release brake system according to claim 23, wherein said compression release actuator comprises a casing non-movable relative to said rocker shaft and a brake-on piston reciprocating within said casing; wherein said brake-on piston defines a brake-on piston cavity within said casing; and wherein said casing includes a fluid port open to said brake-on piston cavity and connected with a source of pressurized fluid.

25. The compression-release brake system according to claim 24, wherein said reset check valve is disposed in said brake-on piston.

26. The compression-release brake system according to claim 25, wherein said reset check valve is normally biased open by a biasing spring.

27. The compression-release brake system according to claim 26, wherein said exhaust valve reset device further includes a rocker check valve disposed in said exhaust rocker arm outside said actuation piston so that said actuation piston cavity is disposed between said rocker check valve and said reset check valve.

28. The compression-release brake system according to claim 27, wherein said rocker check valve is disposed between said actuation piston cavity and said supply conduit.

29. The compression-release brake system according to claim 27, wherein said actuation piston has a communication conduit fluidly connected with said piston cavity through said reset check valve; and wherein said communication conduit in said actuation piston is fluidly connected directly to said supply conduit.

30. The compression-release brake system according to claim 1, wherein the exhaust rocker arm includes a contacting foot facing and selectively engaging an exhaust valve bridge and spaced therefrom by a predetermined valve lash when said exhaust rocker arm is not acting on said exhaust rocker arm.

31. The compression-release brake system according to claim 1, wherein the actuation piston bore is formed at a distal end of said exhaust rocker arm.

32. A method of operation of a compression-release brake system in a brake-on mode for operating at least one exhaust valve of an internal combustion engine during a compression-release engine braking operation, said compression-release brake system maintaining said at least one exhaust valve open during a portion of a compression stroke of the engine when performing the compression-release engine braking operation, said compression-release brake system comprising:

an exhaust rocker assembly for operating said at least one exhaust valve, said exhaust rocker assembly including an exhaust rocker arm mounted about a rocker shaft and selectively pivotable to open said at least one exhaust valve;

an actuation piston moveable between retracted and extended positions and slidably disposed in an actuation piston bore formed in said exhaust rocker arm, said actuation piston operatively coupled to said at least one exhaust valve when in the extended position;

said actuation piston defining an actuation piston cavity within said actuation piston bore between said actuation piston bore and said actuation piston;

a supply conduit formed within said exhaust rocker arm, said supply conduit configured to supply pressurized hydraulic fluid to said actuation piston cavity to displace said actuation piston to the extended position when there is a gap between said actuation piston and said at least one exhaust valve; and an exhaust valve reset device mounted to said exhaust rocker arm and including a reset check valve disposed between said supply conduit and said actuation piston cavity to hydraulically lock said actuation piston cavity by closing said reset check valve when a pressure of the hydraulic fluid within said actuation piston cavity exceeds the pressure of the hydraulic fluid in said supply conduit;

said method comprising the steps of:

mechanically biasing said reset check valve closed during a first part of a valve brake lift of said at least one exhaust valve during a compression stroke of the internal combustion engine;

hydraulically biasing said reset check valve closed during a second part of a valve brake lift of said at least one exhaust valve following the first part during the compression stroke; and resetting said at least one exhaust valve during an expansion stroke of the engine by opening said reset check valve and releasing hydraulic fluid from said actuation piston cavity to close said at least one exhaust valve.

33. The compression-release brake system according to claim 32, wherein said reset check valve is opened due to the decreased pressure of the hydraulic fluid in said actuation piston cavity during the expansion stroke of the internal combustion engine.

34. The compression-release brake system according to claim 32, comprising an exhaust valve bridge and first and second exhaust valves such that said exhaust rocker arm is selectively pivotable to open both said first and second exhaust valves through said exhaust valve bridge.

35. The compression-release brake system according to claim 34, wherein said actuation piston engages only said first exhaust valve in said extended position of said actuation piston.

36. The compression-release brake system according to claim 35, wherein said reset check valve is normally biased closed by a biasing spring; and wherein said reset check valve is mechanically biased closed by said biasing spring during said first half of said valve brake lift of said first exhaust valve during the compression stroke of the internal combustion engine.

* * * * *